US012240656B2

(12) United States Patent
Hoefte et al.

(10) Patent No.: US 12,240,656 B2
(45) **Date of Patent: *Mar. 4, 2025**

(54) PAPER BASED CONTAINER FOR HOUSEHOLD PRODUCTS

(71) Applicant: The Procter & Gamble Company, Cincinnati, OH (US)

(72) Inventors: Paulus Antonius Augustinus Hoefte, Astene (BE); Logan Taylor Brooks, Cincinnati, OH (US); Kassandra Walburger, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 216 days.

This patent is subject to a terminal disclaimer.

(21) Appl. No.: 17/677,226

(22) Filed: Feb. 22, 2022

(65) Prior Publication Data

US 2022/0267044 A1 Aug. 25, 2022

(30) Foreign Application Priority Data

Feb. 22, 2021 (EP) ..... 21158331

(51) Int. Cl.
*B65D 3/22* (2006.01)
*B65D 3/04* (2006.01)
(Continued)

(52) U.S. Cl.
CPC ..... *B65D 3/22* (2013.01); *B65D 3/04* (2013.01); *B65D 3/12* (2013.01); *B65D 3/262* (2013.01); *B65D 5/38* (2013.01)

(58) Field of Classification Search
CPC . B65D 3/22; B65D 3/04; B65D 3/262; B65D 3/28; B65D 2203/12; B65D 5/328;
(Continued)

(56) References Cited

U.S. PATENT DOCUMENTS 3,929,271 A 12/1975 Meyers
4,692,395 A 9/1987 Findlay
(Continued)

FOREIGN PATENT DOCUMENTS

EP 2716561 A1 * 4/2014 ..... B31B 1/00
GB 399123 A 9/1933
(Continued)

OTHER PUBLICATIONS

PCT Search Report and Written Opinion for PCT/US2022/070757 dated Sep. 2, 2022, 22 pages.
(Continued)

*Primary Examiner* — Christopher R Demeree
(74) *Attorney, Agent, or Firm* — Gary J. Foose

(57) ABSTRACT

A container blank including a paperboard shell layer and a core layer. The container blank has a predetermined removable portion the provides for a separable cap portion after the container blank is erected. The container blank can include a lobe for tightly fitting the cap portion to the body portion of the erected container and or provide for a core rim that is located at a rim distance that is a function of position about the longitudinal axis of the container and or include at least one dosing indicia.

15 Claims, 13 Drawing Sheets

(51) Int. Cl.
*B65D 3/12* (2006.01)
*B65D 3/26* (2006.01)
*B65D 5/38* (2006.01)

(58) Field of Classification Search
CPC ..... B65D 2543/00055; B65D 3/263; B65D 5/0281; B65D 5/542; B65D 5/5445; B65D 2203/02; B65D 5/4204; B65D 81/3876; B65D 2203/00; A45D 34/00; A45D 2200/05
USPC ..... 229/4.5, 400, 403, 404, 405, 201, 235, 229/223; 206/515, 830; 220/253, 660, 220/711; 222/105; 239/59
See application file for complete search history.

(56) References Cited

U.S. PATENT DOCUMENTS

| | | | |
|---|---|---|---|
| 5,072,849 | A | 12/1991 | Blau |
| 5,097,948 | A | 3/1992 | Campbell |
| 5,203,470 | A | 4/1993 | Brown |
| 5,408,574 | A | 4/1995 | Deevi |
| 5,897,052 | A | 4/1999 | Tanaka |
| 9,228,288 | B2 | 1/2016 | Davis et al. |
| 9,914,575 | B2 | 3/2018 | You et al. |
| 9,988,190 | B2 | 6/2018 | Berg et al. |
| 11,472,596 | B2 | 10/2022 | Chen et al. |
| 11,505,364 | B2 | 11/2022 | Chen et al. |
| 2004/0007491 | A1 | 1/2004 | Tompkins |
| 2012/0175016 | A1 | 7/2012 | Lopez et al. |
| 2015/0027920 | A1* | 1/2015 | Riordan ..... B65D 25/282 220/660 |
| 2020/0198829 | A1* | 6/2020 | Rizzo ..... B65D 1/40 |
| 2022/0267043 | A1 | 8/2022 | Walburger et al. |
| 2022/0267051 | A1 | 8/2022 | Hoefte et al. |
| 2022/0267074 | A1 | 8/2022 | Brooks et al. |

FOREIGN PATENT DOCUMENTS

| | | | |
|---|---|---|---|
| GB | 2448503 | A | 10/2008 |
| JP | S4877345 | A | 12/1976 |
| JP | S54136117 | U | 9/1979 |
| JP | S5638016 | U | 4/1981 |
| JP | H0219246 | A | 1/1990 |
| JP | H02258544 | A | 10/1990 |
| JP | H0468807 | U | 6/1992 |
| JP | 3078653 | U | 7/2001 |
| JP | 2002104374 | A | 4/2002 |
| JP | 2003342144 | A | 12/2003 |
| JP | 2008254798 | A | 10/2008 |
| JP | 2019064659 | A | 4/2019 |
| KR | 102054395 | B1 | 12/2019 |

OTHER PUBLICATIONS

Extended EP Search Report and Search Opinion for 21158331.5 dated Oct. 8, 2021, 13 pages.
Partial Extended EP Search Report and Search Opinion for 21158331.5 dated Jul. 6, 2021, 14 pages.
All Office Actions; U.S. Appl. No. 17/677,184, filed Feb. 22, 2022.
All Office Actions; U.S. Appl. No. 17/677,205, filed Feb. 22, 2022.
All Office Actions; U.S. Appl. No. 17/677,212, filed Feb. 22, 2022.

* cited by examiner

PAPER BASED CONTAINER FOR HOUSEHOLD PRODUCTS

FIELD OF THE INVENTION

Paper based container for household products.

BACKGROUND OF THE INVENTION

There is continuing interest in recyclable packages for household products, including food products, laundry care products, cleaning products and the like. Paper based containers hold great promise for continued improvements since the recycling stream for paper is well established.

Paper based containers typically operate on the principle that the consumer opens the container to access the contents contained therein, acquires or dispenses the contents from the container, then closes the container so that the remaining contents are protected from the environment or do not accidentally spill from the container. Opening, dispensing or obtaining the contents, and reclosing paper based containers can be inconvenient, particularly if container includes a number of flaps and slots on the end that is to be opened.

Many paper based containers are simple prism or right circular cylinder shaped containers having fold and close mechanisms or interlocking tabs and slots to close the container after the package is first opened. Such closure mechanisms are reasonably sufficient for coarsely sized contents provided that the container remains in an upright position during storage. However, when the container is tipped over or inverted, the closure mechanism often lacks sufficient integrity to maintain the contents of the container therein.

For many paper based containers, the contents are dispensed by pouring the contents from the container. Given that many paper based containers are simple prism or right circular cylinder shaped, pouring from the container occurs over the open rim of the container which can result in uncontrollable pouring. Often, flaps at the open end of the container interfere with pouring or make it difficult for the user see and controllably pour the contents from within the container. This can make it difficult for users to precisely dispense the desired quantity of contents from the container.

With these limitations in mind, there is a continuing unaddressed need for paper based containers that can be easily opened and securely reclosed. Further, there is a continuing unaddressed need for paper based containers that provide for controllably dosing of the contents from the container.

SUMMARY OF THE INVENTION

A container blank (12) comprising: a paperboard shell layer (20) comprising two transverse edges (22) on opposing sides of a central axis (A), a shell bottom edge (30) extending between said transverse edges orthogonal to said central axis, and a shell top edge (40) opposite said shell bottom edge and extending between said transverse edges; wherein said shell layer comprises: a body portion (50) extending from said shell bottom edge to a lower line of limitation (60); a predetermined removeable portion (70) extending from said lower line of limitation to an upper line of limitation (80); and a cap portion (90) extending from said upper line of limitation to said shell top edge; and a paperboard core layer (100), wherein when said core layer is in facing relationship with said shell layer said core layer extends from below said lower line of limitation to a core rim (180) above said upper line of limitation; wherein when said core layer is in facing relationship with said shell layer said core rim is located at a rim distance (190) from said shell bottom edge as measured parallel to said central axis and said rim distance is a function of distance from said central axis; and wherein when said core layer is in facing relationship with said shell layer said core rim has a rim distance global maxima (200) and a rim distance global minima (210) relative to said shell bottom edge.

A container blank (12) comprising: a paperboard shell layer (20) comprising two transverse edges (22) on opposing sides of a central axis (A), a shell bottom edge (30) extending between said transverse edges orthogonal to said central axis, and a shell top edge (40) opposite said shell bottom edge and extending between said transverse edges; wherein said shell layer comprises: a body portion (50) extending from said shell bottom edge to a lower line of limitation (60); a predetermined removeable portion (70) extending from said lower line of limitation to an upper line of limitation (80); and a cap portion (90) extending from said upper line of limitation to said shell top edge; and a paperboard core layer (100), wherein when said core layer is in facing relationship with said shell layer said core layer extends from below said lower line of limitation to a core rim (180) above said upper line of limitation; wherein said body portion comprises a lobe (120) immediately below said lower line of limitation and has a body portion length (52) between said transverse edges orthogonal to said central axis immediately below said lobe; wherein said lobe has a lobe length (142) orthogonal to said central axis and said lobe length is more than 5% of said body portion length; wherein said lobe has a lobe exterior height (150) parallel to said central axis and said lobe has a lobe length to lobe height ratio greater than 1.

A container blank comprising: a paperboard shell layer (20) comprising two transverse edges (22) on opposing sides of a central axis (A), a shell bottom edge (30) extending between said transverse edges orthogonal to said central axis, and a shell top edge (40) opposite said shell bottom edge and extending between said transverse edges; wherein said shell layer comprises: a body portion (50) extending from said shell bottom edge to a lower line of limitation (60); a predetermined removeable portion (70) extending from said lower line of limitation to an upper line of limitation (80); and a cap portion (90) extending from said upper line of limitation to said shell top edge; and a paperboard core layer (100) comprising two core layer side edges (21), wherein when said core layer is in facing relationship with said shell layer said core layer extends from below said lower line of limitation to a core rim (180) above said upper line of limitation and one of said side edges is further away from said central axis than one of said transverse edges.

DETAILED DESCRIPTION OF THE INVENTION

Figure 1:
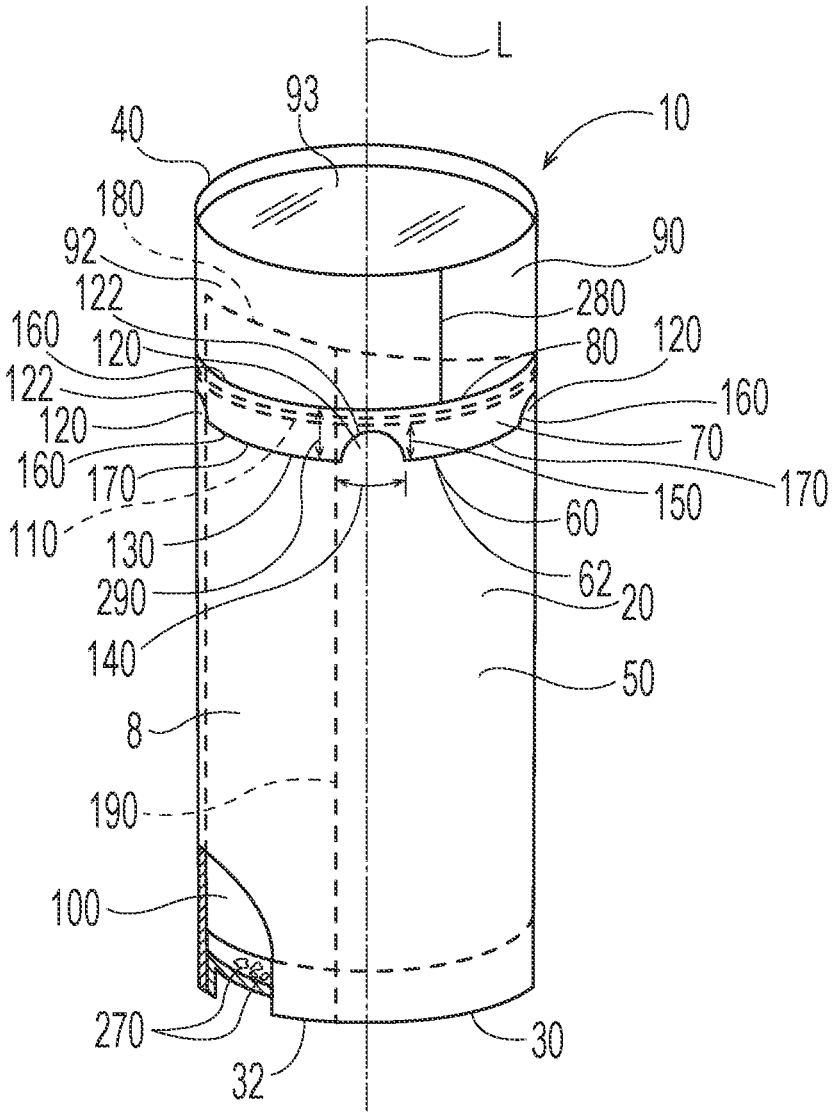
FIG. 1. An unopened container.

A container 10 having aspects as those described herein is shown in FIG. 1. The container 10 can have paperboard shell layer 20 about a longitudinal axis L. The container 10 can have a height along the longitudinal axis from about 50 mm to about 600 mm, optionally from about 50 mm to about 200 mm. The area of the container 10 orthogonal to the longitudinal axis L can be from about 10 $cm^2$ to about 300 $cm^2$, optionally from about 30 $cm^2$ to about 100 $cm^2$. The interior volume of the container can be from about 100 mL to about 2 L, optionally from about 300 mL to about 1600 mL.

The container 10 can have a base 32 upon which the container 10 is designed to rest. The container base 32 can have a maximum external dimension from about 5 cm to about 50 cm. A cylindrical container 10 may have a container base having an exterior diameter from about 5 cm to about 50 cm. A cylindrical container 10 having an exterior diameter from about 5 cm to about 20 cm, optionally from about 5 cm to about 10 cm, can be practical. A container 10 having an exterior diameter from about 5 cm to about 20 cm, or even from about 5 cm to about 18 cm, can be conveniently gripped by a user. The container 10 shown in FIG. 1 is a hollow right circular cylinder having closed ends. Other hollow shapes for the container 10 are contemplated, for example an oval column, irregularly shaped column, a prism, or any other statically stable shape.

The paperboard shell layer 20 and the paperboard core layer 100 can individually have a basis weight greater than 250 $g/m^2$, optionally from about 250 $g/m^2$ to about 800 $g/m^2$. The paperboard can be single- or multi-ply. The paperboard shell layer 20 and paperboard core layer 100 can each have a thickness from about 0.3 mm to about 2 mm. The paperboard core layer 100 and paperboard shell layer 20 can be coated with a substance so that the material is printable, to protect the contents of the container 10, protect the paperboard materials of the container 10 from the contents, or to provide a sealable or heat sealable layer. For example, a sealable or heat sealable layer or coating can be provided on the surface of the paperboard shell layer 20 oriented towards the longitudinal axis L and the surface of the paperboard shell layer 20 oriented away from the longitudinal axis L. Such coatings or layers can help provide for sealing or heat sealing of the paperboard shell layer 20 along the longitudinal seam 230. A coating or layer to provide for sealing or heat sealing can be provided only at locations proximal the longitudinal seam 230. Ink and or varnish may be applied to the paperboard materials on one or both of the surface facing away from the longitudinal axis L or the surface facing towards the longitudinal axis L. Paper board materials may be made in whole or partially from fibrous cellulose material. Fibrous cellulose material can be virgin, recycled, or a mixture thereof. Cellulose materials may be obtained from hardwood, softwood, or other natural renewable resources for fibers. Fibrous cellulose material can be obtained from bamboo, wheat straw, bulrush, corn, rice husk, sugar cane, grass fiber, or from recycled paper and paperboard. The exterior and or interior surfaces of the container 10 can be coated with a natural or polymeric coating, by way of nonlimiting example, polyethylene, polyethylene terephthalate, or polypropylene, to provide a moisture barrier. Coatings of wax, clay, starch, kaolin, polyethylene terephthalate, polypropylene, polylactic acid, silicates, ethylene vinyl alcohol, polyvinyl alcohol, and other natural and or biodegradable coatings that adequately provide a barrier against moisture and or oxygen and or fragrance migration into or out of the container 10 can be useful. The core layer 100 can be a spiral wound paperboard material that is cut to an appropriate length and has an outer diameter that is closely conforming to the interior surface of the shell layer 20. The core layer 100 can be wrapped around a mandrel to form a tube having the appropriate length.

The container 10 can be practical for containing articles 270 including, but not limited to, laundry scent additive particles, powder laundry detergent, soluble unit does pouches of laundry detergent, laundry detergent tablets, powder dish detergent, soluble unit dose pouches of dish detergent, dish detergent tablets, laundry benefit additives, chlorine tablets, hard surface cleaning tablets. The container can contain articles 270 that comprise perfume. The container can contain articles 270 that comprise unencapsulated perfume. The articles 270 can be particles. The articles 270, which can be particles, can comprise a water soluble or water dispersible carrier and perfume. The articles 270, which can be particles, can comprise from about 1 wt % to about 99 wt % a water soluble or water dispersible carrier and from about 0.1 wt % to about 80 wt % a fabric care benefit agent. The fabric care benefit agent can be selected from the group consisting of perfume, fabric softener, wrinkle releaser, color protector, color rejuvenator, soil release polymer, antistatic agent, malodor reduction agent, antimicrobial, anti-redeposition compound, optical brightener, graying inhibitor, dye transfer inhibitor, antioxidant, and combinations thereof. The articles 270, which can be particles, can have an individual article 270 mass from about 1 mg to about 2 g. The water soluble carrier can be a water soluble salt, water dispersible solid, water soluble carbohydrate, water dispersible carbohydrate, water soluble polymer, water dispersible polymer, by way of nonlimiting examples, sodium chloride, sugar, starch, polysaccharide, polyethylene glycol, block copolymers, and the like. The articles 270 can be particles described in U.S. Pat. No. 10,167,441 and 10,377,966.

The container 10 can be practical for containing goods such as food products including, but not limited to, pasta, rice, tea, flour, baking powder, baking soda, potato chips, pretzels, cereal, oats, barley, beans, seasonings, cookies, nutritional supplements, pelleted food products, crackers, and the like. The container 10 can be practical for containing medicinal pills, vitamins, nutritional supplements, dry pet food, dry pet snacks, and the like.

The container 10 can be sized and dimensioned to contain from about 50 g to about 1500 g of articles 270, for example particles. The articles 270 can be a fabric care benefit product. The articles 270 can be particles that comprise a water soluble or water dispersible carrier and a fabric care benefit agent selected from the group consisting of unencapsulated perfume, encapsulated perfume, surfactant, enzyme, bleach, brightener, hueing dye, deposition aid, anti-redeposition aid, foam inhibitor, fabric softener, dye transfer inhibitor, soil release polymer, antioxidant, and combinations thereof.

The container 10 can contain from about 30 g to about 1200 g, optionally from about 100 g to about 800 g, optionally from about 100 g to about 600 g, of articles. The shell layer 20 can extend from the shell bottom edge 30 to a shell top edge 40. The shell layer 20 can form the majority of the container 10. The shell layer 20 can form the outside or exterior surface of the container 10.

The shell layer 20 can comprise a body portion 50. The body portion 50 forms at least part of the lower portion 8 of the container 10. The body portion 50 can extend from the shell bottom edge 30 to a lower line of limitation 60. The shell bottom edge 30 can be the part of the container 10 upon which the container 10 is designed to sit when placed on a flat surface.

The lower line of limitation 60 can define the upper boundary 62 of the body portion 50. A predetermined removable portion 70 can extend from the lower line of limitation 60 to an upper line of limitation 80. The predetermined removable portion 70 can extend about the longitudinal axis L, partially, substantially, or completely. The predetermined removable portion 70 can extend about the longitudinal axis except at the longitudinal seam 230. The lower line of limitation 60 and upper line of limitation 80 can each be a line of frangibility 160 around or partially around the longitudinal axis L. The line of frangibility 160 can be perforations, partial cuts, or weakened portions of the shell layer 20. The line of frangibility 160 can be a structure that can be manually torn by the user in a controllable manner along a predetermined path around or partially around the longitudinal axis L of the container 10. For example, the line of frangibility 160 can be a series of intermittent through cuts, a series of score cuts, a series of perforations from which material has been removed, a score line, a partial die cut, partial die cuts on opposing surfaces, offset partial die cuts on opposing surfaces, a zipper die cut, or the like. The line of frangibility 160 can be reinforced with a tape that is applied to the inside of the shell layer 20. Polyethylene, polypropylene, or polyethylene terephthalate tape applied to the shell layer 20 can help guide tearing and prevent unintentional breakage of the line of frangibility 160. The line of frangibility 160 can be defined by a plurality of structural disruptions of the shell layer 20 spaced apart from one another. A lobe 120 can be defined by more than two structural disruptions. The structural disruptions can be selected from the group consisting of through cuts, score cuts, through die continuous cuts, partial die continuous cut, partial die cuts, zipper die cuts, reversed partial die continuous cut, reversed partial die interrupted cut, perforations from which material has been removed, laser cut, and combinations thereof.

The upper line of limitation 80 can be orthogonal to the longitudinal axis L. A straight upper line of limitation 80 can be easy for the user of the container 10 to tear when the container 10 is being opened. Furthermore, a straight upper line of limitation 80 can provide for a cap portion 90 that has straight lip and is convenient to use as a dispensing and or dosing cap.

When the container 10 is in an unopened condition, predetermined removable portion 70 connects the body portion 50 to the cap portion 90. The cap portion 90 extends from the upper line of limitation 80 to the shell top edge 40. The cap portion 90 can form at least part of the upper portion 9 of the container 10. The container 10 can be prepared to open for the first time by removing the predetermined removable portion 70 from the container 10. A tear strip 110 engaged with the predetermined removable portion 70 and positioned between the predetermined removable portion 70 and the core layer 100 can be provided to assist the user with tearing the predetermined removable portion 70 from the container 10. Once the predetermined removable portion 70 is removed from the container 10, the cap portion 90 can be separated from the body portion 50 by the user to access the contents of the container 10.

The container 10 can further comprise cap end 93. The cap end 93 can form a closed end of the cap portion 90. The cap end 93 can close off the top of the container 10, the top of the container 10 being the end of the container associated with the cap portion 90. The cap end 93 can be a separate piece of paperboard fitted with the cap portion 90 near the shell top edge 40. Optionally, the cap end 93 can be a flap or flaps of paperboard that are integral extensions of the cap portion 90 that are folded to form the cap end 93.

To provide for a container 10 that is easily opened and reclosed, it can be practical to provide for a core layer 100 extending at least partially about the longitudinal axis L and interior to the shell layer 20. The core layer 100 can be described as being between the shell layer 20 and the longitudinal axis L. Once the container 10 is opened, the core layer 100 can provide for structure that can guide fitting of the cap portion 90 to one or more parts of the body portion 50 to reclose the container 10.

The core layer 100 can be joined to the body portion 50. The core layer 100 can be joined to the body portion 50 below the lower line of limitation and not above the lower line of limitation. The core layer 100 can be joined to the body portion 50 only at locations below the lower line of limitation. The core layer 100 and the body portion 50 can be glued, taped, or heat sealed otherwise bonded to one another to join the two parts. The glue can be a hotmelt, cold glue, or pressure sensitive glue. The core layer 100 can extend from below the lower line of limitation 60 to above the upper line of limitation 80. The cap portion 90 can be unaffixed to the core layer 100 above the lower line of limitation 60. The cap portion 90 can be unaffixed to the core layer 100 above the optional tear strip 110. The cap portion 90 can be unaffixed to the core layer 100 above the predetermine removeable portion 70. Being in such an unaffixed state can make the cap portion 90 easy to twist and or slide off of the core layer 100 to remove the cap portion 90 from the body portion.

Optionally, the container 10 can comprise a tear strip 110 between the predetermined removable portion 70 and the core layer 100 and extends around or at least partially about the longitudinal axis L. The tear strip 110 can be joined to the predetermined removeable portion 70. The tear strip 110 can be a piece of adhesive tape adhered to the shell layer 20. The backing layer of the adhesive tape can be polyethylene, polypropylene, oriented polypropylene, polyethylene terephthalate, polyamide, nylon, or other polymers, yarns, and filaments. The adhesive layer of the adhesive tape can be a pressure sensitive glue, heat sensitive glue, solvent or water based adhesive, or similar. The tear strip 110 can help to controllably transmit user applied tearing force to the predetermined removeable portion 70 so that the predetermined removable portion 70 is controllably torn from the shell layer 20.

To open the container 10, the user can pull on the tear strip 110 or a free end of the predetermined removeable portion 70 to initiate tearing of the predetermined removeable portion 70 from the body portion 50 and the cap portion 90. The tearing can occur along or near each of the lower line of limitation 60 and the upper line of limitation 80 along the respective lines of frangibility 160. Once the predetermined removeable portion 70 is removed from the container 10, the cap portion 90 can be easily removed from the body portion 50 to access the contents of the container 10. Once the cap portion 90 is removed, the contents of the container 10 can be dispensed and or measured into the cap portion 90 and used in a directed manner. The cap portion 90 can be used as a dosing cup for household products, a serving cup for food products, a measuring cup for consumable dry goods, or similar use.

There are some types of paperboard containers that have been designed to provide for convenient opening. Unfortunately, designs of paperboard containers that are easy to open are often difficult to securely close. For example, paperboard cereal and pasta containers are notorious for being difficult to securely close and the contents of containers like these are frequently spilled when the container tips over as the user pulls out a drawer from a pantry or accidentally bumps a container on a shelf or countertop.

The container 10 may contain from about 50 g to about 1500 g of articles 270. After first opening the container 10 to use the contents of the container 10, the user may desire to securely close the container 10. That way, if the container 10 is accidentally tipped over or inverted, the contents of the container 10 will not spill out. A face to face frictional engagement between the cap wall interior facing surface and the core layer 100 that sticks up above the lower line of limitation 60 may not be sufficient to maintain the container 10 in a reclosed condition, particularly if the contents of the container 10 are heavy. This may be because the coefficient of friction between typical paperboard materials is low and the cap portion 90 may not be able to apply a high enough normal stress since the cap portion 90 may relax to some degree after being fitted over the core layer 100. To that end, a mechanism for more securely reclosing the container 10 may be desirable. A mechanism based on one or more wedges may be practical.

To provide for a sufficiently secure closure mechanism for a container 10 as described herein, the body portion 50 of the container 10 can comprise a lobe 120 immediately below the lower line of limitation 60. The shape of the lobe 120 per se can be defined by the lower line of limitation 60. That is, the lower line of limitation 60 can form the upper boundary 62 of the body portion. A lobe 120 is a flap or projection of the of the body portion 50 that extends higher up on the core layer 100, that is be longitudinally more extensive, than parts of the body portion 50 adjacent to the lobe 120.

Once the cap portion 90 is removed from the body portion 50, the user may desire to reclose the container 10 by placing the cap portion 90 back on the body portion 50. The core layer 100 can be a guide for fitting the cap portion 90 onto the body portion 50. The lobe 120 can function as a wedge to provide for mechanical engagement of the cap portion 90 to the body portion 50 when the container is reclosed. The cap portion 90 has the same peripheral shape as the body portion 50 and may need to be deformed or stretched to fit over the lobe 120.

The body portion 50 can have a peripheral exterior length 130 orthogonally about the longitudinal axis L immediately below the lobe or lobes 120. If the container 10 has a shape of a right circular cylinder, the peripheral exterior length 130 is the circumference of the outer surface of the container 10 immediately below the lobe or lobes 120. If the container 10 has the shape of a prism, the peripheral exterior length 130 is the sum of the widths of the faces of the prism. If the container has the shape of a square prism, the peripheral exterior length 130 is the four times the width of a face of the prism. If multiple lobes 120 are provided, then the peripheral exterior length 130 is measured immediately below the lobe 120 that is closest to the shell bottom edge 30 of the container 10. The peripheral exterior length 130 is a scalar quantity. The peripheral exterior length 130 can be from about 10 cm to about 70 cm. The peripheral exterior length 130 can be from about 20 cm to about 40 cm.

Each lobe 120 can have a lobe exterior height 150 parallel to the longitudinal axis L. The lobe exterior height 150 is the maximum dimension of the lobe 120 measured parallel to the longitudinal axis L and the datum from which the lobe exterior height 150 is measured is a line that connects the ends of the lobe 120 being measured. For semicircular or semi-oval lobes 120, the lobe exterior height 150 is the radius of the semicircle. For square lobes 120, the lobe exterior height 150 is the edge length of the square. For trapezoidal lobes 120, the lobe exterior height 150 is the height of the trapezoid. For triangular lobes 120, the lobe exterior height 150 is the height of the triangle. Lobes 120 adjacent to one another can have lobe exterior heights 150 that vary from one another. Such lobes 120 having a staggered lobe exterior height 150 may provide for variable engagement of the cap portion 90 with the body portion 50 depending on how far down the cap portion 90 is pushed towards the body portion 50. The lobe exterior height 150 is a scalar quantity. The lobe exterior height can be from about 1 mm to about 30 mm.

Each lobe 120 can have a curved upper contour 122. A curved upper contour 122 may be easier to tear along as compared to an upper contour 122 comprising straight segments. Further a curved upper contour 122 may be easier to engage with the cap portion 90 once the container 10 is opened and then the cap portion 90 is used to close the container 10. The curved upper contour 122 may provide for a gradual engagement or wedging of the cap portion 90 to the body portion 50. As the user deforms the cap portion 90 to fit over the lobe or lobes 120, the rounded or curved upper contour 122 provides for gradual engagement of the cap portion 90 with the lobe or lobes 120 so that the lobe or lobes 120 can be gently wedged between the cap portion 90 and the core layer 100.

Each lobe 120 can have a lobe exterior length 140 orthogonal to or about the longitudinal axis L. If the body portion 50 is cylindrical, the lobe exterior length 140 is measured on the exterior surface of the body portion 50 and along the part of the circumference of the body portion 50 where the lobe 120 being characterized is present. If the body portion 50 is a regular right prism, the lobe exterior length 140 is measured on the exterior surface of the body portion 50 and along part of the periphery of the body portion 50 where the lobe 120 being characterized is present. Portions of a lobe 120 may reside on adjacent faces of the body portion 50.

The lobe exterior length 140 can be more than about 5% of the peripheral exterior length, optionally more than about 10% of the peripheral exterior length, optionally from about 5% of the peripheral length to about 30% of the peripheral length, optionally from about 5% of the peripheral length to about 20% of the peripheral length, optionally from about 10% of the peripheral length to about 25% of the peripheral length. The lobe exterior length 140 can be from about 1 mm to about 60 mm Each lobe 120 can have a lobe exterior length 140 to lobe exterior height 150 greater than about 1. Lobes 120 having such aspect ratio can provide for a predetermined removeable portion 70 that can be easily separated from the body portion 50 of the container 10. As the predetermined removable portion 70 is removed by pulling on the predetermined removeable portion 70 and tearing the predetermined removeable portion 70 along the upper line of limitation 80 and lower line of limitation 60, the limited directional variation of the lower line of limitation 60 reduces the potential for the tear line to deviate from the lower line of limitation 60. Taller lobes 120 or a lower line of limitation 60 that has vertices or abrupt changes in direction may result in the tear line not optimally following the lower line of limitation 60 when the predetermined removable portion 70 is removed.

The body portion 50 can comprise a plurality of lobes 120. For example, the body portion 50 can comprise two lobes 120. The two lobes 120 can be spaced apart from one another by straight segments 170 of the lower line of limitation 60. Optionally, the two lobes 120 can be on opposite sides of the longitudinal axis L. Optionally, the body portion 50 can comprise three or four lobes 120 spaced apart about the longitudinal axis L, optionally evenly spaced apart about the longitudinal axis L. The lobes 120 can be spaced apart from one another by from about 10% to about 80% of the peripheral exterior length 130. Such spacing can be practical for providing room for the cap portion 90 to be deformed to wedge fit over the lobes 120 when the cap portion is reengaged with the body portion 50 after the container is opened. The lobes 120 can be spaced apart from one another by about 1 mm to about 350 mm, optionally from about 10 mm to about 100 mm, optionally from about 20 mm to about 80 mm.

Figure 2:
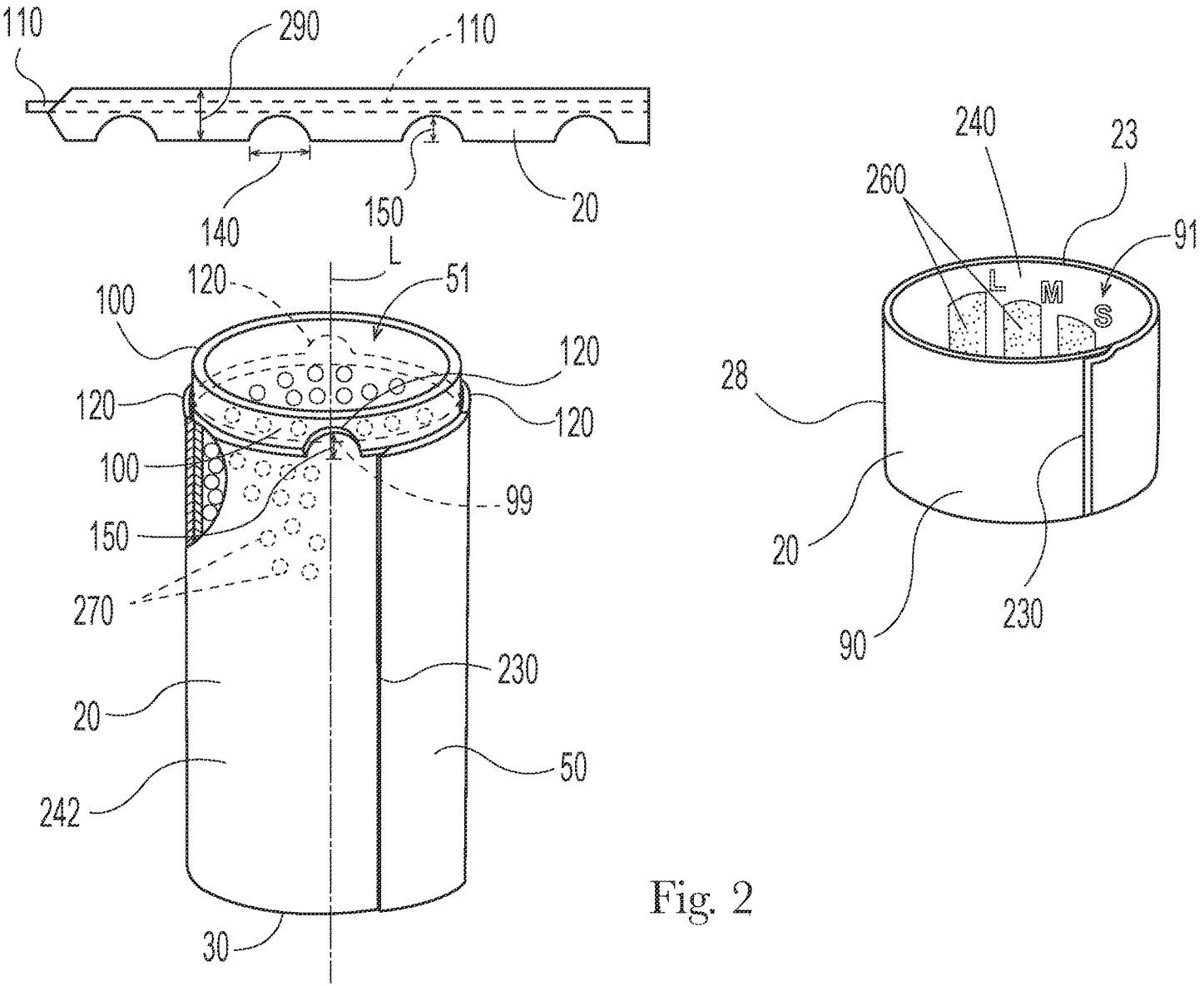
FIG. 2. An opened container in which the predetermined removeable portion, cap portion, and predetermined removable portion are separated from one another.

An open container 10 is shown in FIG. 2. In FIG. 2, the predetermined removable portion 70 is separated from the cap portion 90 and the body portion 50. The user of the container 10 can place the predetermined removable portion 70 in a recycling collection bin or waste bin. The core layer 100 can extend above the upper line of limitation 80. The core layer 100 can extend above the upper line of limitation 80 by more than about 5% of the peripheral exterior length 130, optionally from about 5% of the peripheral exterior length to about 50%, optionally from about 5% of the peripheral exterior length to about 30%, of the peripheral exterior length. Such an arrangement provides for a core layer 100 that can support the lobes 120 when the cap portion 90 is fitted onto the body portion 90 to close the container 10 after opening.

The core layer 100 can be discontinuous about the longitudinal axis L. This can simplify erection of the container 10 since the vertical edges of the core layer 100 need not be precisely fitted to and joined to one another.

The cap portion 90 can serve as a measuring cup for measuring out quantities of the contents 10 of the container. The cap portion 90 can be sized and dimensioned to have an cap portion interior volume that corresponds to a single dose. In that instance, a completely full cap portion 90 can correspond to a single dose of the contents of the container 10. The cap portion 90 can be sized and dimensioned to have a cap portion interior volume that corresponds to two doses of the contents of the container 10. In that arrangement, a half-full cap portion 90 can correspond to a single dose of the contents of the container 10. A full cap portion 90 and half full cap portion 90 may be intuitive for the user measure out if no dosing indicia 260 are provided. Optionally, dosing indicia 260 can be provided on the interior facing surface 240 of the cap portion 90. The dosing indicia 260 can be printed lines, numbers, or graphics, embossments, debossments, pictures, or text that are indicative to the user of the quantity of the contents of the container 10 that is required to provide for the intended use or intended benefit of the contents of the container 10. The dosing indicia 260 can be printed, embossed, or debossed on the blank or part of the blank from which the container 10 is erected. The dosing indicia 260 can include a numerical indicator of the size of the dose to deliver the intended benefit. The dosing indicia 260 can be printed on what becomes the interior facing surface 240 of the cap portion 90 by a printing process selected from the group consisting of digital printing, flexography, letterpress printing, offset printing, rotogravure printing, and screen printing. The dosing indicia 260 can be printed, embossed, or debossed on flat paperboard on the surface that will become the interior facing surface 240 before the container 10 is erected, which is a comparatively simpler process than performing the same processes on the interior of an erected container 10.

The paper based container 10 described herein has a particular advantage over a plastic based container. For plastic based containers, the dosing indicia 260 may molded into the cap. Molds for plastic parts are expensive. If the manufacturer of the of the contents of the container 10 desires to change the formula of the contents of the container 10, for example by compacting the formulation, a new mold must be employed to make a cap that has molded dosing indicia marked to provide the desired dose. For the paper based container 10 described herein, the dosing indicia can be inexpensively changed since only a change to a printing, embossment, or debossment process of a flat substrate from which the container 10 is erected is needed. Printing, embossment, and debossment of flat paper substrates tends to be a relatively inexpensive process to implement and make changes thereto compared to implementing and changing plastic molding processes and manufactured parts.

Before the container 10 is first opened, the cap portion 90 is part of shell layer 20. The shell layer 20 can have an interior facing surface 240 oriented towards the longitudinal axis L and an opposing exterior facing surface 242. The interior facing surface 240 above the lower line of limitation 60 can comprise the at least one dosing indicia 260.

The cap portion interior 91 can have a cap portion interior volume from about 10 mL to about 400 mL. The container 10 can have an body portion interior 51 and the body portion interior volume from the bottom end 34 to the upper line of limitation 80 can be from about 50 mL to 2000 mL. The cap portion interior volume can be from about 0.5 to about 50% of the body portion interior volume. That arrangement can provide for a container 10 that contains from about 1 to about 80, optionally from about 18 to about 20, doses of articles 270.

The articles 270 in the container can be filled to a fill level 99. The fill level 99 can be below the core rim 180. Such an arrangement can be practical if the articles 270 have a propensity to fall out of the lower part of the container 10 when the container 10 is opened in an upright position. Articles 270 that are particles may have a such a propensity to spill out of the container 10 upon opening. The fill level 99 can be below the upper line of limitation 80. That fill level can reduce the potential for accidental spilling of the articles 270 from the container 10 as the container 10 is opened.

In a formed container 10, the shell layer 20 can comprise a longitudinal seam 230 extending at least partway between the shell bottom edge 30 and the shell top edge 40, optionally extending from the shell bottom edge 30 to the shell top edge 40 excluding the predetermined removable portion 70. The longitudinal seam 230 can be a butt seam or overlapping seam and comprise a glue or tape, or be heat sealed to help maintain integrity of the longitudinal seam 230. The longitudinal seam 230 can be glued, taped, or heat sealed at spaced apart locations along the longitudinal seam 230. The longitudinal seam 230 can be a flange seam in which both edges of the shell layer 20 along the longitudinal axis L each have a flange and the flanges are joined to one another. The flange seal can be tucked towards the interior of the container 10 or be oriented outwardly from the container 10 with tucking towards the interior of the container 10 being more discrete. The flanges of the flange seal constituting the longitudinal seam 230 can be glued, or taped, or heat sealed to one another.

The cap portion 90 can have a cap portion height 280 measured parallel to the longitudinal axis L between the upper line of limitation 80 and the shell top edge 40. The predetermined removeable portion 70 can have a predetermined removeable portion maximum height 290 measured parallel to the longitudinal axis L. The predetermined removeable portion maximum height 290 is measured at an appropriate location which will be away from a lobe 120. The cap portion height 280 can be greater than the predetermined removable portion height 290. Such an arrangement can provide for a cap portion 90 that can be fully fitted over the core layer 20 to close the container 10 after opening.

Figure 3:
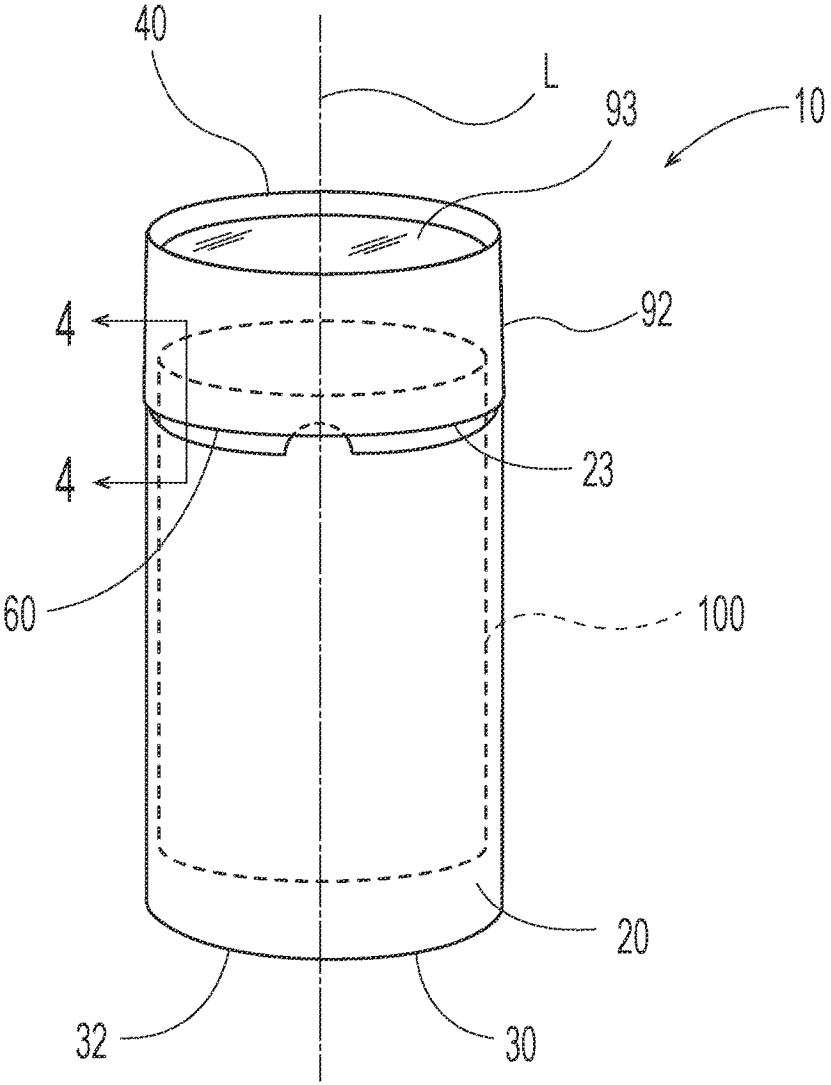
FIG. 3. A reclosed container in which the cap portion is fitted over the lobes.

The user opens the container 10 by removing the predetermined removable portion 70 from the container 10. The cap portion 90 is then separated from the body portion 90 so that the user can access the contents of the container 10. After a portion of the contents of the container 10 have been dispensed, the user can reclose the container 10, for example as shown in FIG. 3. As shown in FIG. 3, the cap wall interior facing surface 240 is oriented towards the longitudinal axis L. The lobe 120 or lobes 120 can be wedged between the cap wall interior facing surface 240 and the core layer 100. As described herein, the cap portion 90 and body portion 50 are formed from the shell layer 20. The lobes 120 are integral extensions of the body portion 50. As such, the cap portion 90 cannot fit over the lobes 120 unless the lip 23 of the cap portion 90 is deformed to fit or slide over the lobes 120. For a cylindrical cap portion 90, user can gently squeeze the cap wall 92 on opposing sides which results in hoop stress being applied to cap wall 92. The deformation of the cap wall 92 in such manner can provide for room for portions of the cap wall 92 away from the location that the squeezing forces are applied to deform away from the longitudinal axis L and be slid over the lobe 120 or lobes 120. Once the hoop stress is relieved by the user ceasing to squeeze the cap wall 92, the cap wall 92 relaxes and leaves the lobe 120 or lobes 120 wedged between the core layer 100 and the cap wall interior facing surface 240. The frictional fit and wedging of the cap portion 90 to the body portion 50 can help securely close the container 10. The frictional fit and wedging, provides a resistance force in the direction of the longitudinal axis L when the cap portion 90 is pulled away from the body portion 50 or pushed away from the body portion 50 by the contents of the container 10 if the closed container 10 is tipped over sideways or inverted.

Figure 4:
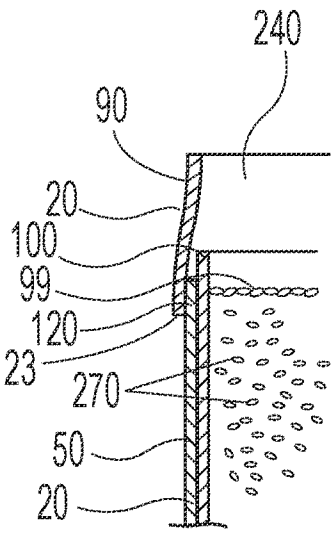
FIG. 4. A partial view as indicated in FIG. 3.

In FIG. 4, a partial cross sectional view of a container 10 is shown that has been first opened by removing the predetermined removable portion 70 and separating the cap portion 90 and then reclosed by replacing the cap portion 90 onto the body portion 50. As shown in FIG. 4, the cap portion 90 can be deformed to be fitted over the lobe 120. The lobe 120 is wedged between the cap wall interior facing surface 240 and the core layer 100.

The body portion 50 can be provided with one or more lobes 120. When only a single lobe 120 is provided, the reclosed cap portion 90 may be fitted over the lobe 120 and the interior facing surface 240 of the core layer 100 opposite to the location of the lobe 120 may be in contact with the core layer 100. The wedging of the lobe 120 in between the cap portion 100 and core layer 100 plus the frictional engagement between the interior facing surface 240 of the cap portion 90 and the core layer 100 opposite the lobe 120 can be sufficient to reasonably securely maintain the container 10 in a closed condition after the container 10 has been first opened.

A plurality of lobes 120 can provide additional wedging locations to more securely close a previously opened container 10. Two lobes 120 can be advantageously positioned on opposite sides of the longitudinal axis L. In that arrangement, the user can gently pinch the lip 23 between his or her thumb and forefinger, for example at a 12 o'clock and 6 o'clock positions, to deform the lip 23 so that locations positions at the 3 o'clock and 9 o'clock positions along the lip 23 are outwardly deformed and can be slide over the lobes 120.

Four lobes 120 can be advantageously evenly spaced out at the 1:30 o'clock, 4:30 o'clock, 7:30 o'clock, and 10:30 o'clock position on the body portion 50. The user can gently pinch the lip 23 at the 12 o'clock and 6 o'clock positions to deform the lip 23 so that the locations along the lip 23 corresponding the lobes 120 are deformed to fit over the four lobes 120.

Figure 5:
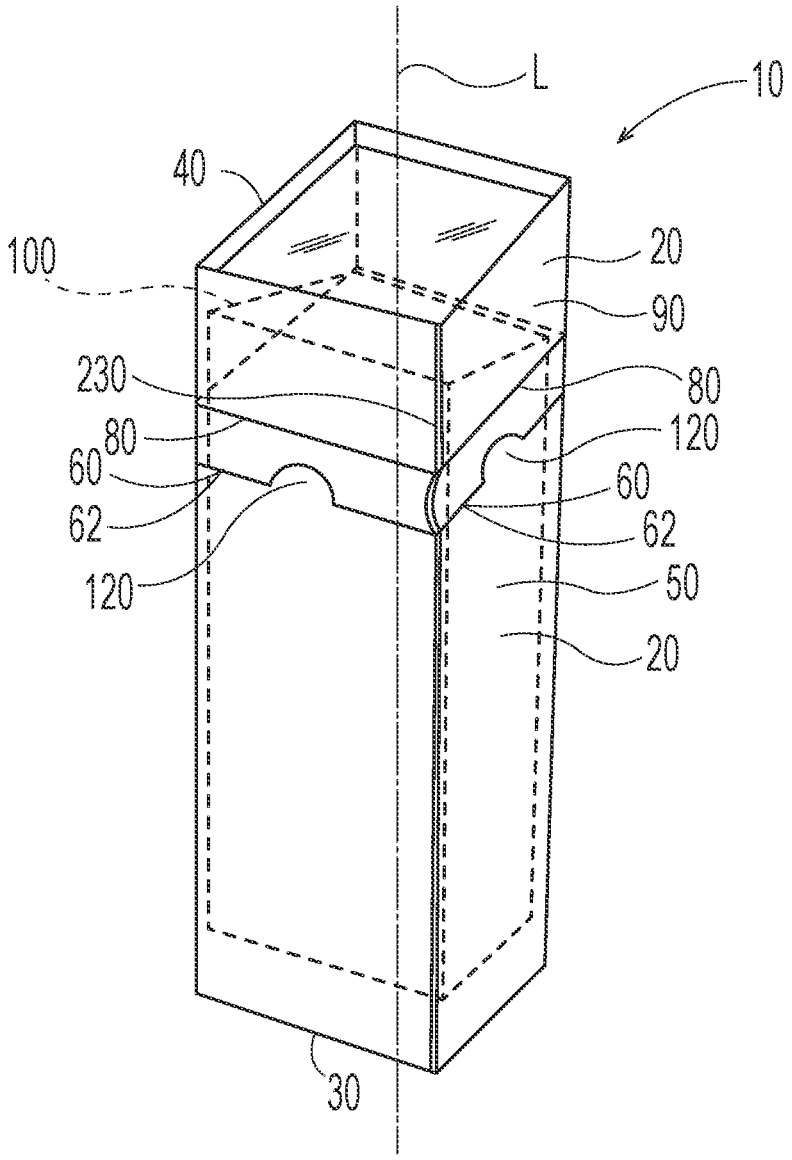
FIG. 5. A unopened container.

The container 10 can be a regular right prism, optionally a regular right rectangular prism (FIG. 5). The base 32 of the container 10 can have a shape selected from the group consisting of square, rectangular, triangular, pentagonal, hexagonal, heptagonal, octagonal, oval, elliptical, and stadium. The container can have a shape selected from the group consisting of a regular right rectangular prism, a regular right triangular prism, a regular right square prism, a regular right pentagonal prism, a regular right hexagonal prism, a regular right heptagonal prism, regular right octagonal prism, right circular cylinder, regular right oval, regular right ellipse, a regular right stadium, and shapes that are substantially such shapes within typical manufacturing tolerances and in recognition of the slight variations in the shapes that might occur as a result of longitudinal seams, including overlapping seams, in the core layer and or shell layer that are used construct the container 10. The container 10 can have an internal or external cross sectional shape orthogonal to the longitudinal axis L selected from the group consisting of a circle, an oval, an irregular rounded shape, a square, a rectangle, a triangle, a pentagon, a hexagon, a heptagon, an octagon, an ellipse, an oval, and a stadium. Regular right rectangular, regular right square, and regular right triangular prisms can be efficiently packed, in an outer case, on a pallet, or shelf. Regular right rectangular and regular right square prisms are well suited for ecommerce shipping. Rounded containers 10 such as right circular cylinders, regular right oval, regular right ellipse, and regular right stadium can be structurally stable due to their curved shells along the longitudinal axis L.

Figure 6:
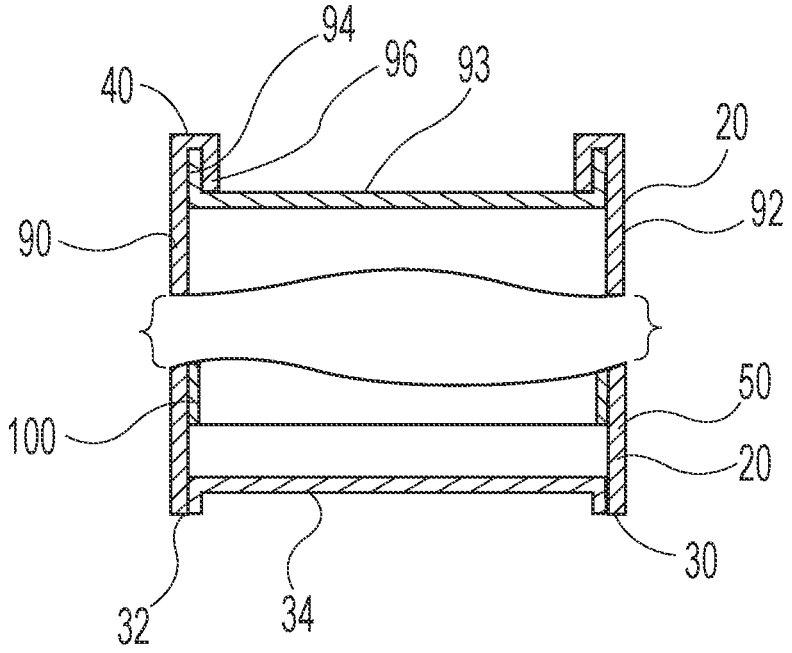
FIG. 6. A cross sectional view of the top and bottom of a container.

The cap end 93 can be an insert in the top of the container 10, as shown in FIG. 6. The cap end 93 can be paperboard or corrugate. The cap end 93 can comprise a flange 94 peripherally extending from the cap end 93. The flange 94 can be glued, taped, or heat sealed to the interior facing surface 240 of the cap portion 90. Optionally, the flange 94 can be tucked within a folded extension 96 integrally extending from the shell top edge 40. The folded extension 96 can be glued, taped, or heat sealed to the flange 94 and the flange 94 can optionally be glued, taped, or heat sealed to the interior facing surface 240 of the cap portion 90. A similar construct can be provided to form the bottom end 34. The bottom end 34 can comprise a flange 94 peripherally extending from the bottom end 34. The flange 94 can be glued, taped, or heat sealed to the interior facing surface 240 of the body portion 50. Optionally, the flange 94 can be tucked within a folded extension 96 integrally extending from the shell bottom edge 30 of the body portion 50. The folded extension 96 can be glued, taped, or heat sealed to the flange 94. The flange 94 can optionally be glued, taped, or heat sealed to the interior facing surface 240 of the body portion 50. Employing a folded extension 96 within which the flange 94 is positioned between opposing parts of the folded extension 96 and glued, taped, or heat sealed to the folded extension 96 can provide for a sturdy container 10. A cold, hotmelt, or pressure sensitive glue or a heat seal or tape or other bond can be used to join the cap end 93 to the shell layer 20.

The container 10 can be a closed ended container. The shell top edge 40 can be closed by a cap end 93. The shell bottom edge 30 can be closed by a bottom end 34. The cap end 93 can be opposite the bottom end 34. The cap end 93 can be proximal the shell top edge 40 and form a closed end at the shell top edge 40. The bottom end 34 can be proximal the shell bottom edge 30 and form a closed end at the shell bottom edge 30.

Figure 7:
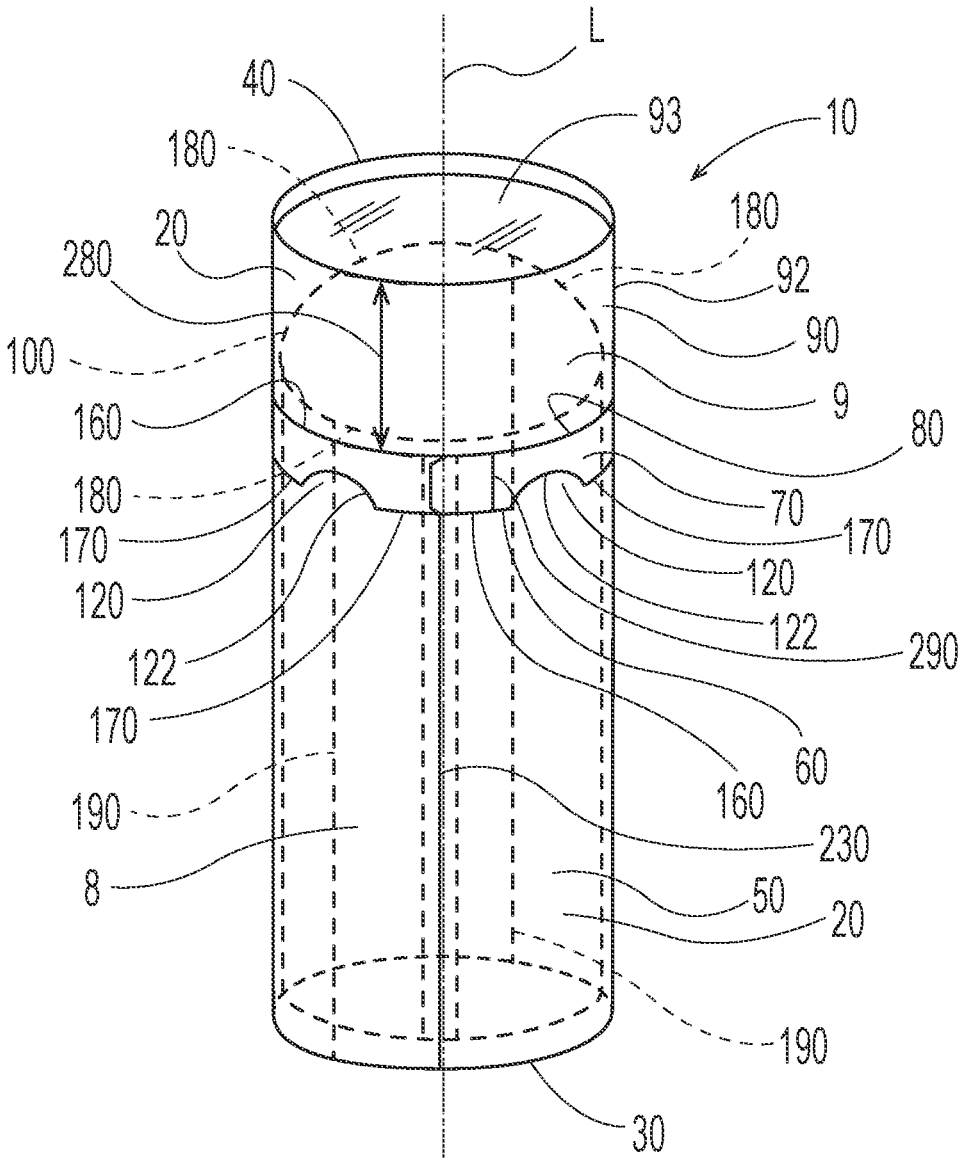
FIG. 7. An unopened container.

As shown in FIG. 7, the container 10 can be provided with a structure that can provide for convenient dispensing of the contents from the container 10. The core layer 100 can extend to a core rim 180 above the upper line of limitation 80. In this arrangement, the core layer 100 can provide for back support of the lobe or lobes 120 when they are employed to securely reclose the container 10. The core rim 180 can be below the shell top edge 40 so that the cap portion 90 can fit over the core layer 100.

A simple construction of the container 10 is one in which longitudinal seam 230 is nearer to a low point of the core rim 180 than the high point of the core rim 180, as that may simplify layout of the blank from which the container 10 is erected. The core rim 180 is located at a rim distance 190 from the shell bottom edge 30 as measured parallel to the longitudinal axis L. The rim distance 190 can be a function of position about the longitudinal axis L.

A container 10 in which the rim distance 190 is not a function of position about the longitudinal axis L is shown in FIG. 2. For the container 10 shown in FIG. 2, the rim distance 190 is constant. Including a non-flat contour to the core 180 can provide for convenient dispensing of the contents of the container 10.

Figure 8:
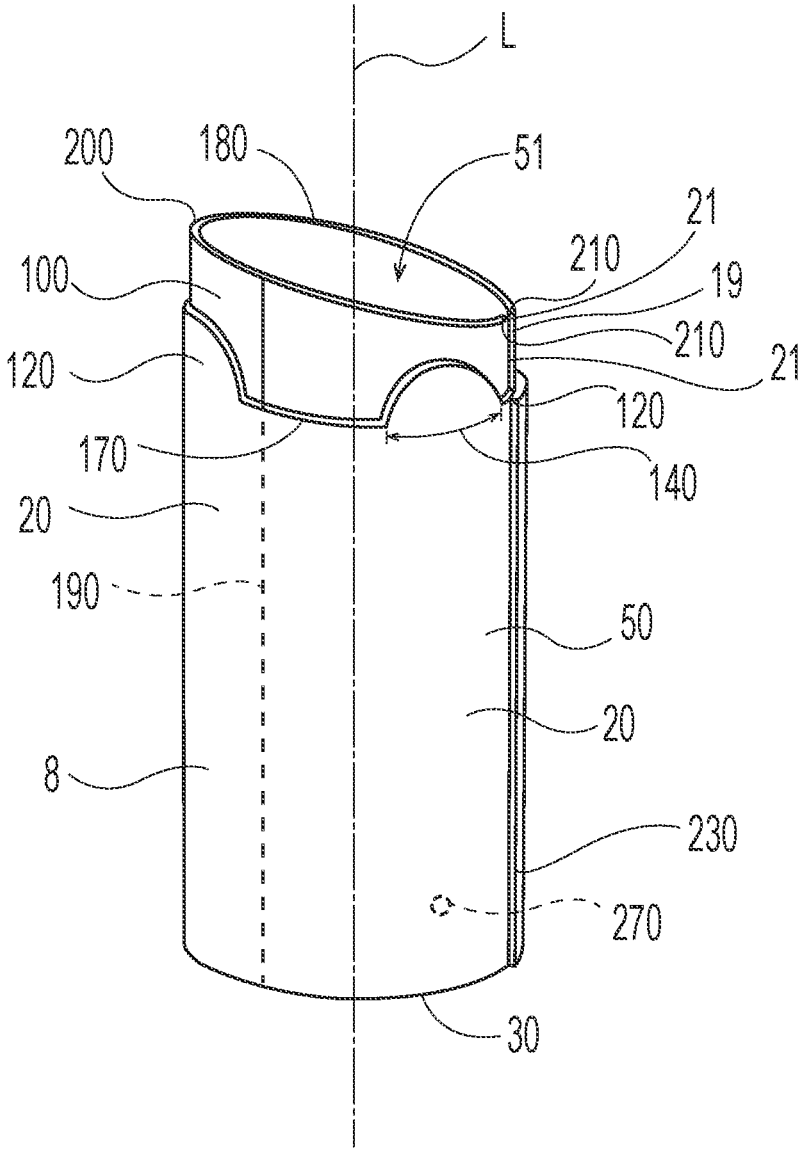
FIG. 8. An opened container.

The core rim 180 can have a rim distance global maxima 200 and a rim distance global minima 210 relative to the shell bottom edge 30 (FIG. 8). The rim distance global maxima 200 and rim distance global minima 210 are locations, not scalar quantities. The variation in rim distance 190 can provide for structures that function as a pour spout or weir to help control dispensing from the container 10. One practical arrangement is a core rim 180 that is an elliptical. For a cylindrical core layer 100, notwithstanding that there can be a small discontinuous portion following the height of the container 10, the core rim 180 can be defined by a cylindrical section. Similarly, a for a prismatically shaped container 10, the core rim 180 can be defined by a prismatic section. For example, the core rim 180 in FIG. 5 graphically rendered in dashed lines, can be a rectangle. The core rim 180 can be parallel to a plane oriented at an angle that is more than about 5 degrees out of plane with respect the shell bottom edge 30. The core rim 180 can be parallel to a plane oriented at an angle that is more than about 10 degrees, or even more than about 20, 30, or 40 degrees, out of plane with respect the shell bottom edge 30. The rim distance global maxima 200 can be the location on the core rim 180 over which the contents of the container 10 can be poured.

The shell top edge 40 can be above the rim distance global maximum 200 by more than the predetermined removable portion height 290. This can provide for enough space for the removed cap portion 90 to be fitted over the lobe 120 or lobes 120 to reclose the container 10.

To provide for improved structural stability of the container 10, at the rim distance global minima 210 the core layer 100 can extend above the upper line of limitation 80 by more than about 5%, optionally from about 5% to about 75%, optionally from about 5% to about 50%, optionally from about 5% to about 30%, of the peripheral exterior length 130. In that arrangement, the core layer 100 can support the back of the lobe 120 or lobes 120 and the shell layer 20 of the body portion 50.

The rim distance global maxima 200 and the rim distance global minima 210 can be positioned such that the longitudinal axis L is between the rim distance global maxima 200 and the rim distance global minima 210. This arrangement can help the user easily identify the location along the core rim 180 that can be conveniently used to pour the contents of the container 10.

In one practical construction, the core layer 100 can be discontinuous at a position about the longitudinal axis L at a location within about 40 degrees, or even within about 20 degrees, or event withing about 10 degrees, or even within about 5 degrees, of the rim distance global minima 210 as measured about the longitudinal axis L. A discontinuity located as such can provide convenient design of the blank from which the container 10 is erected and provide the user a visual cue as to how the container 10 should be aligned in his or her hand when pouring from the container 10. The core layer 100 can be discontinuous over a width about the longitudinal axis L. The width of the discontinuity 19 is the distance between the core layer side edges 21 at the core rim 180. As described herein, the core layer 20 extends between the core layer side edges 21 and for an erected container 10 the core layer 20 extends at least partially about the longitudinal axis L, or even entirely about the longitudinal axis L. The width can be measured between the core layer side edges 21. The width of the discontinuity 19 can be less than the minimum dimension of an article 270. The width of the discontinuity 19 can be sized and dimensioned to retain articles 270 stored within the container 10. The width of the discontinuity 19 can be sized and dimensioned so that articles 270 stored within the container 10 cannot pass through the discontinuity 19. This can reduce the potential for an article 270 to unintentionally pass through the discontinuity 19 when the container 10 is opened or the articles 270 are dispensed from the container 10. The width can be less than or equal to the nominal sieve opening size at which 100 wt % of the articles 270 in the container 10 is retained. The width of the discontinuity 19 can be smaller than the size of each of the individual articles 270 in the container 10.

The longitudinal seam 230 can be within about 40 degrees of the rim distance global minima 210 as measured about the longitudinal axis L. Optionally the longitudinal seam 230 can be within about 20 degrees, or within about 10 degrees, or within about 5 degrees of the rim distance global minima 210, as measured about the longitudinal axis L. The blank for such a container 10 can be more convenient to design. And such a blank can be practically erected.

The cap end 93 can be formed by flaps 98 that are integral extensions of the shell layer 20 that forms the cap portion 90.

Figure 9:
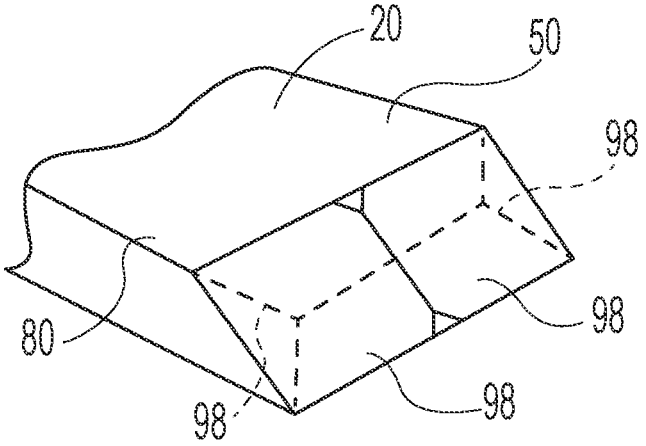
FIG. 9. A partial view of the bottom of a container.

The flaps 98 can be folded over one another and joined to one another by a tape, glue, such as a cold, hotmelt or pressure sensitive glue, or a heat seal or other type of bond (FIG. 9). Likewise, the bottom end 34 can formed by the same structure with the flaps 98 being integral extensions of the shell layer 20 that forms the body portion 50.

Figure 10:
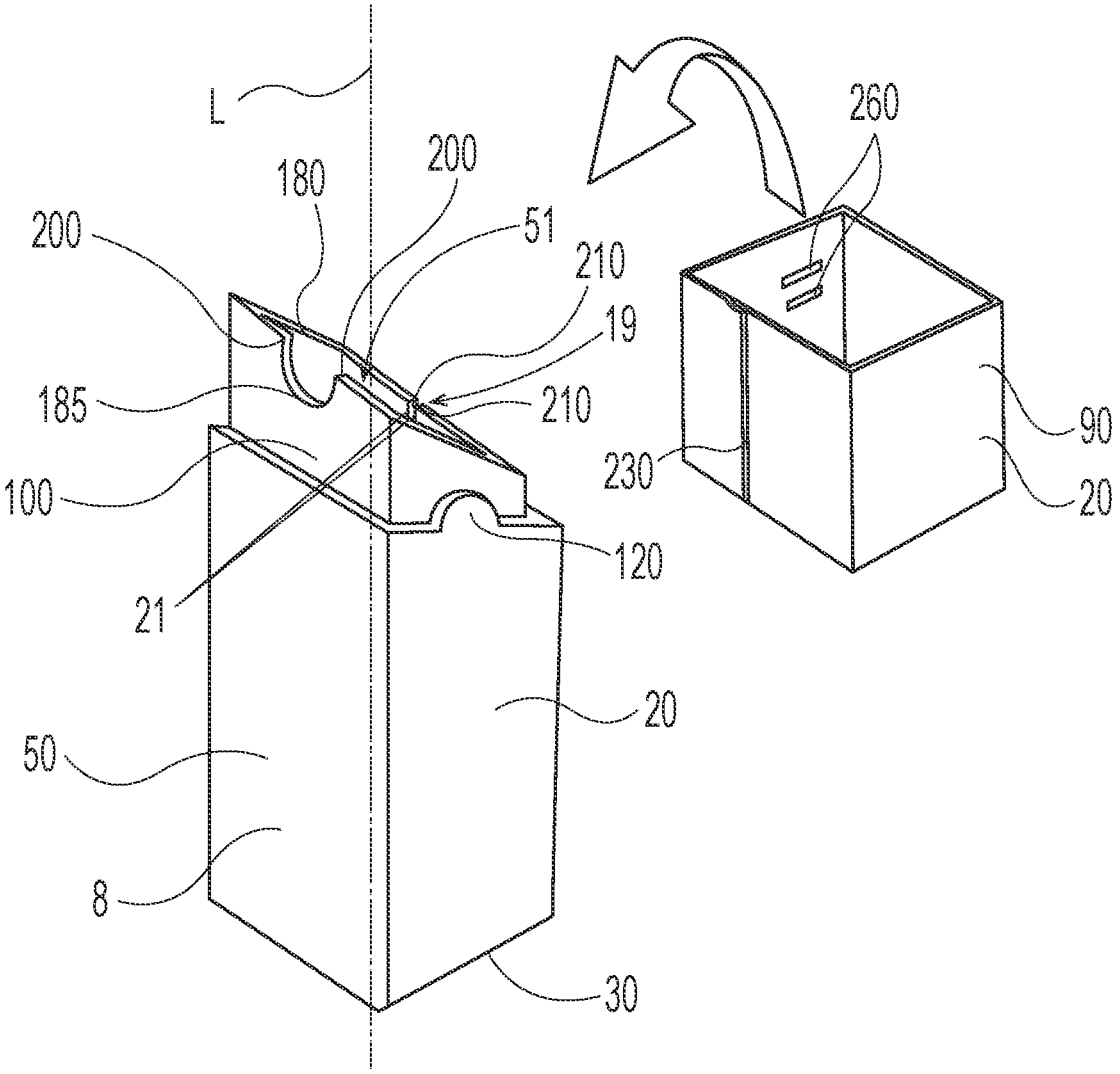
FIG. 10. An opened container.

The core rim 180 can be provided with a notch 185 to channel pouring of the contents of the container 10 (FIG. 10). The notch 185 can be a V-shaped notch, semi-circular notch, trapezoidal notch or another shape that can channel flow of granular materials. The notch 185 can be located proximal the rim distance global maxima 200. The notch 185 can be positioned opposite the longitudinal seam 230. The notch 185 can have a depth below the core rim 180 of more than about 10% of the peripheral exterior length 130. The notch 185 can function as a weir to provide for controllable pouring from the container 10.

Figure 11:
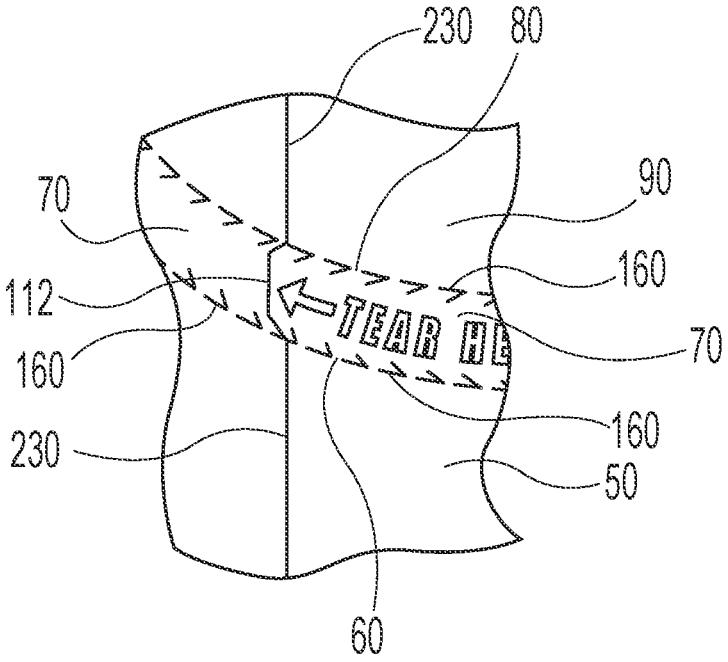
FIG. 11. A partial view of a predetermined removable portion.

A variety of structures are contemplated for helping the user remove the predetermined removable portion 70 (FIG. 11). The predetermined removable portion 70 can comprise a free end 112 to initiate tearing of the predetermined removeable portion 70 from the container 10. The user can pull on the free end 112 to initiate tearing of the predetermined removeable portion 70 away from the body portion 50 and cap portion 90. The free end 112 can have the shape a pull tab, such as a trapezoidal end, semicircular end, triangular end, or a curved end. The free end 112 can be peripherally more extensive than the upper line of limitation 80 and lower line of limitation 60. The free end 112 can be from about 1 mm to about 5 mm peripherally more extensive than the upper line of limitation 80 and the lower line of limitation 60. The free end 112 or tear strip 110 can be located at the longitudinal seam 230. Located as such, the lower line of limitation 60 and upper line of limitation do not need to cross the longitudinal seam 230. That may reduce the potential for tearing the longitudinal seam 230 when the predetermined removeable portion 70 is torn from the container 10.

The free end 112 of the predetermined removeable portion can be located where the core layer 100 is discontinuous about the longitudinal axis L. Such a location can simplify the design of the blank from which the container 10 is constructed since the end of the tear strip 110 can be located at a transverse edge of the blank.

If the container 10 is provided with a core rim 180 that that is at an angle relative to the longitudinal axis L or is provided with some other structure to improve dispensing from the container 10, the free end 112 can be within about 40 degrees, optionally within about 20 degrees, optionally within about 10 degrees, optionally within about 5 degrees of the longitudinal seam 230 as measured about the longitudinal axis L. The longitudinal seam 230 can be unconnected or weakly connected beneath the predetermined removeable portion 70 so that the predetermined removeable portion 70 can be easily separated from the container 10 proximal the longitudinal seam 230. The longitudinal seam 230 can extend from the shell bottom edge 30 to the shell top edge 40 excluding the predetermined removable portion 70. The longitudinal seam 230 can extend from the shell bottom edge 30 to the shell top edge 40 excluding the predetermined removable portion 70 and be glued, taped, or heat sealed along the longitudinal seam 230.

By way of nonlimiting example, as shown in FIG. 11, a line of frangibility 160 can be defined by a plurality of structural disruptions 16 of the shell layer 20 spaced apart from one another.

Additional detail of the optional tear strip 110, which is described previously, is shown in FIG. 12, which is a partial view of a container 10. The optional tear strip 110 can provide for improved control of removing the predetermined removable portion 70 from the container 10. The tear strip 110 can have an initiation end 220 that is external to the container 10. If the container 10 is provided with a core rim 180 that is at an angle relative to the longitudinal axis L or is provided with some other structure to improve dispensing from the container 10, the tear strip 110 can have an initiation end 220 that is within about 40 degrees, optionally within about 20 degrees, optionally within about 10 degrees, optionally within about 5 degrees of the global minima 210 as measured about the longitudinal axis L. Such arrangements can be practical so that the tear strip 110 starts proximal to or at the longitudinal seam 230.

The optional tear strip 110 can be located where the core layer 100 is discontinuous about the longitudinal axis L. Such a location can simplify the design of the blank from which the container 10 is constructed since the end of the tear strip 110 can be located at a transverse edge of the blank. When the container 10 is erected, the tear strip 110 is positioned near the longitudinal seam 230.

Figure 12:
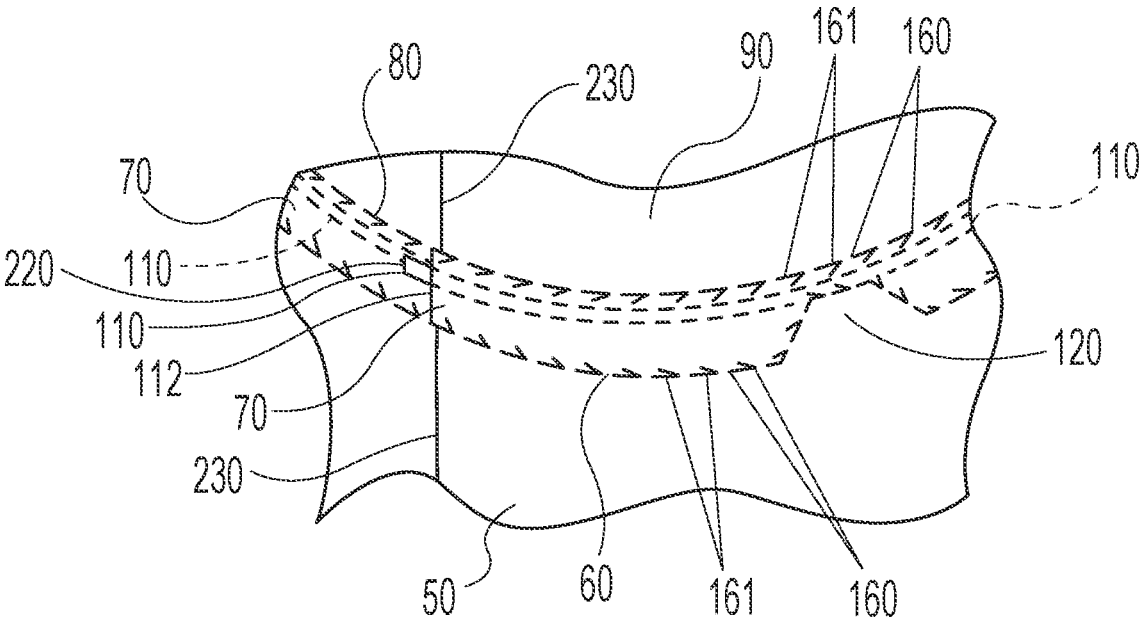
FIG. 12. A partial view of a predetermined removable portion.

By way of nonlimiting example, as shown in FIG. 12, a line of frangibility 160 can be defined by a plurality of structural disruptions 161 of the shell layer 20 spaced apart from one another. The lobe 120 can be defined by more than two structural disruption 161.

Figure 13:
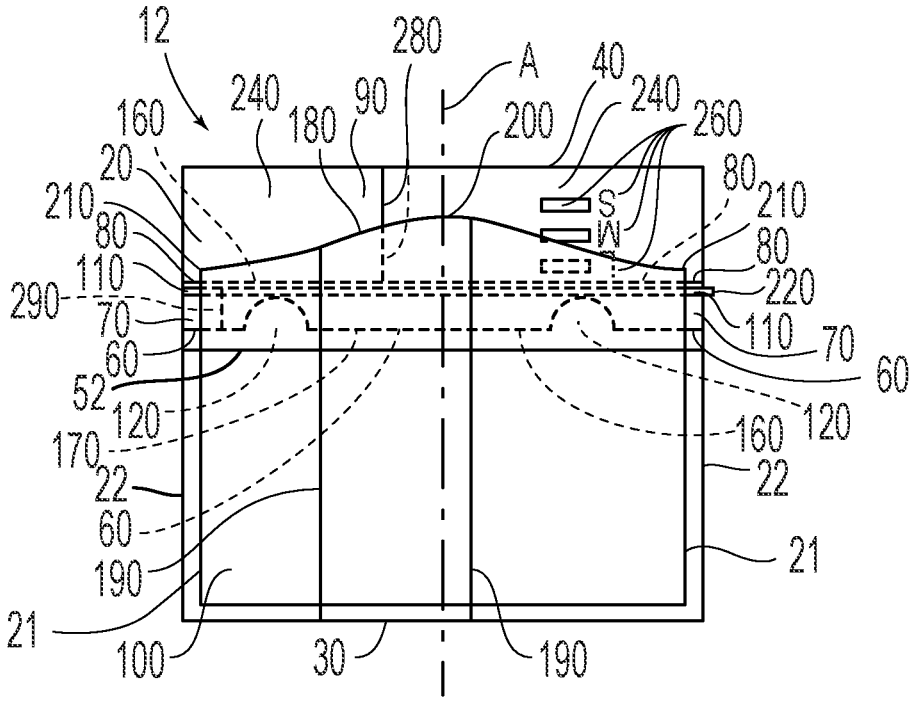
FIG. 13. A blank for constructing a container.

The container 10 can be practically formed from a container blank 12, as shown in FIG. 13. The blank 12 can be erected into the container 10 by wrapping the blank 12 around a mandrel to transform the flat blank 12 into a partially formed container 10. A cap end 93 can be mechanically fitted or trapped by folding and forming a brim from the paperboard shell layer 20 or fitted and glued, taped, or heat sealed into the open top and bottom to form the container 10. Optionally flaps 98 that extend form the shell layer 20 can be folded and glued, taped, or heat sealed to one another to form the top and bottom of the container 10. A hotmelt or pressure sensitive glue, tape, or heat seal can be practical. Other known bonding or welding techniques can be used.

The container blank 12 can be a laminate of paperboard materials. The blank 12 can comprise the paperboard shell layer 20. The shell layer 20 can comprise two transverse edges 22 on opposing sides of a central axis A. The paperboard shell layer 20 can comprise a shell bottom edge 30 extending between the transverse edges 22 orthogonal to the central axis A. The paper board shell layer 20 can comprise a shell top edge 40 opposite the shell bottom edge and extending between the transverse edges 22. Like the container 10, the shell layer 20 of the blank 12 can comprise a body portion 50 extending from the shell bottom edge 30 to the lower line of limitation 60. The shell layer 20 can comprise a predetermined removeable portion 70 extending from the lower line of limitation to an upper line of limitation 80. The upper line of limitation 80 can be orthogonal to or substantially orthogonal to the central axis A. The cap portion 90 can extend from the upper line of limitation 80 to the shell top edge 40.

The paperboard core layer 100 can be provided in facing relationship with the shell layer 20. The core layer 100 can be glued, taped, or heat sealed to the shell layer 20 to provide for rigidity to the erected container 10 and provide blank that can be manipulated to erect a container 10. The core layer 100 can extend from below the lower line of limitation 60 to the core rim 180 above the upper line of limitation 80. The core layer 100 can be glued, taped, heat sealed, or otherwise joined to the shell layer 20.

The core layer 100 can extend from and be unitary with one of the transverse edges 22 and be foldable about the transverse edge 22. That is, a single sheet of paperboard can form both the shell layer 20 and the core layer 100. Constructing the blank 12 from a single sheet of paperboard can be attractive since individual sheets of paperboard do not need to be precisely positioned with respect to one another during assembly. Further, a single die cut can be made to construct the shell layer 20 and the core layer 100 from a single flat sheet. The single die cut sheet can be folded along the intended location of the transverse edge 22 to bring the core layer 100 into facing relationship with the shell layer 20 to form the two layer blank 12. Optionally, the core layer 100 and shell layer 20 can be nonunitary. For example, the shell layer 20 and the core layer 100 can be individual pieces of paperboard that are assembled to form the blank 12.

When the core layer 100 is in facing relationship with the shell layer 20, the core rim 180 can be located at a rim distance 190 from the shell bottom edge 30 as measured parallel to the central axis A. The rim distance 190 can be constant if a core rim 180 that is defined by a circle perpendicular to the longitudinal axis L is desired for the container 10.

The rim distance 190 can be a function of the distance from the central axis A. Such an arrangement can be used to create a core rim 180 that varies in distance from the bottom edge 30 as a function of position about the longitudinal axis L of the container 10. When the core layer 100 is in facing relationship with the shell layer 20, the core rim 180 can have a rim distance 190 global maxima 200 and a rim distance global minima 210 relative to the shell bottom edge 30. When such a blank 12 is erected into a container 10, the global maxima 200 and global minima 210 correspond to the same discussed above with respect to the container 10. The global maxima 200 can be located at the central axis A. When the container 10 is erected, the global maxima 200 can be opposite the longitudinal seam 230.

The core rim 180 of the blank 12 can be sinusoidal. A blank 12 having a sinusoidal core rim 180 can be erected to provide a container 10 in which the core rim 180 is a cylindrical section. The core rim 180 can be defined by two straight line segments 170 having an interior angle less than 170 degrees. The two straight line segments 170 can approach the central axis A. The interior angle is the interior angle over the over the core layer 100. When a blank 12 constructed as such is rolled about the longitudinal axis L, the resulting core 180 is sloped relative to the shell bottom edge 30. The transverse edges of the core layer 100 can be shorter than the core layer 100 along the central axis A. If prism shape container 10 is desired, the shape of the core rim 180 for the blank 12 can be designed so that when the blank 12 is folded about the longitudinal axis, the core rim 180 of the container has the desired shape.

The blank 12 can be designed so that the shell top edge 40 is away from the shell bottom edge 30 by a distance greater than the rim distance global maxima 200 plus a maximum distance between the upper line of limitation 80 and the lower line limitation 60 measured parallel to the central axis A. This can provide for the cap portion 90 being able to fit over the part of the core layer 100 that sits above the lower line of limitation 60. Similarly, the cap portion 90 can have a cap portion height 280 measured parallel to the central axis A between the upper line of limitation 80 and the shell top edge 40. The predetermined removeable portion 70 can have a predetermined removeable portion maximum height 290 measured parallel to the central axis A and the cap portion height 280 can be greater than the predetermined removeable portion height 290.

To provide for enhanced control of the tearing path of the predetermined removable portion 70, the predetermined removable portion 70 can extend between and intersect the transverse edges 22 of the shell layer 20.

The lines of frangibility 160 can be provided in the blank 12. If the layers of paperboard are die cut, the die can include crease and cutting knives, partial cutting knives, reversed partial cutting knives or perforations, knives, or combinations thereof or other structures to form the lines of frangibility 160. Optionally, the lines of frangibility 160 can be formed in the shell layer 20 after die cutting the overall shape of the shell layer 20 and core layer 100, for instance by another die or applying a score line or intermittent score line or laser cut or the like to the shell layer 20.

To form a container 10 in which the core layer 100 sticks up above the lower line of limitation 60 sufficiently to act as a guide for replacing the cap portion 90 onto the body portion 50 to reclose the container, the core layer 100 can extend above the upper line of limitation 80 by more than about 5%, or from about 5% to about 50%, optionally from about 5% to about 30%, of the body portion length 52. The body portion length 52 is measured between the transverse edges 22 orthogonal to the central axis A immediately below the lower line of limitation 60.

The paperboard from which the blank 12 is constructed can be printed. For example, the shell layer interior facing surface 240 can comprise the dosing indicia 260. A portion of core layer 100 can be in facing relationship with the shell layer 20. The dosing indicia 260 can be provided on the interior facing surface 240 above the lower line of limitation 60. Printing can also be provided on the exterior surface of the container formed by the shell layer 20. Printing is technically simpler to perform on flat sheets, or reels, or pieces of paperboard than printing on shaped containers 10. For example, the printing of the dosing indicia 260 and the printing on the exterior the container 10 can be performed on continuous web of paperboard stock. The paperboard stock can be cut to form the blank 12 or component parts of the blank 12.

An optional tear strip 110 can be joined to the predetermined removable portion 70 before or after die cutting of the shell layer 20. The optional tear strip 110 can be between the core layer 100 and the shell layer 20.

The lobe or lobes 120 can be provided in the blank 12. The body portion 50 can comprise a lobe 120 immediately below the lower line of limitation 60. The body portion 50 can have a body portion length 52 measured between the transverse edges 22 orthogonal to the central axis A immediately below the lobe or lobes 120. The lobe or lobes 120 can have a lobe length 142 orthogonal to the central axis A and the lobe length can be more than about 5%, optionally more than about 10%, optionally from about 5% to about 30%, optionally from about 5% to about 20%, of the body portion length 52. Additionally, the lobe or lobes 120 can have a lobe exterior height 150 parallel to the central axis A and the lobe length 142 to lobe exterior height 150 ratio can be greater than about 1.

Like the container 10, the blank 12 can comprise a plurality of lobes 120. And the upper line of limitation 80 can be orthogonal to the central axis A. The container blank 12 can comprise two lobes 120 spaced apart from one another by straight segments 170 of the lower line of limitation 60. The body portion 50 can comprise two lobes 120 and the lobes 120 can be on opposite sides of the central axis A. The lobes 120 can be spaced apart from one another by from about 10% to about 80% of the lobe length 142.

The lobe or lobes 120 provided as part of the blank can be sized and dimensioned to provide the lobe or lobes 120 in the erected container 10. The lobes 120 can be spaced apart from one another from about 10% to about 80% of the lobe length 142. The lobe or lobes 120 can have a curved upper contour 122 and the lobes 120 adjacent one another can have lobe exterior heights 150 that vary from one another.

Figure 14:
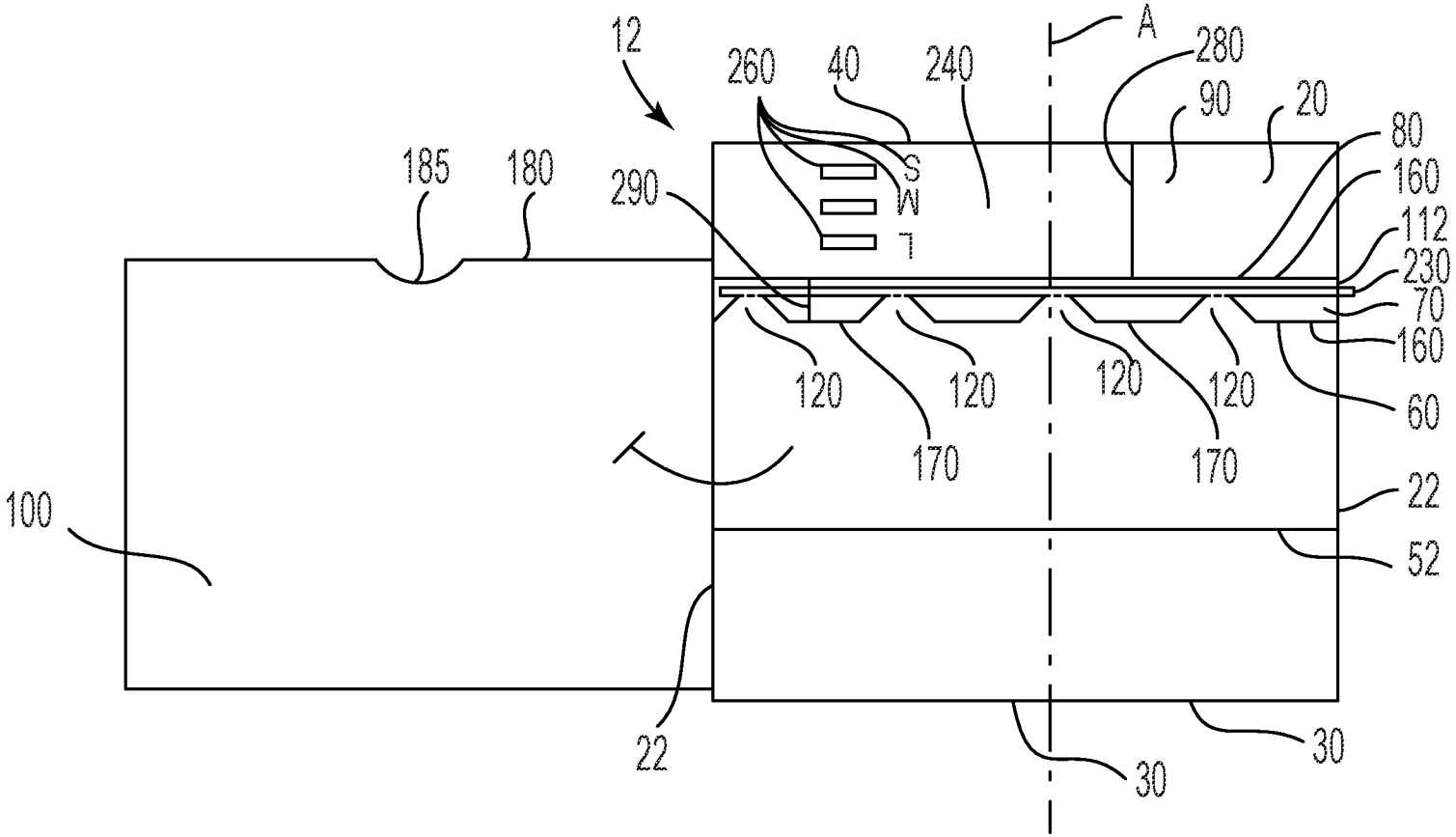
FIG. 14. A blank for constructing a container.

A similar blank 12 is shown in FIG. 14, the blank 12 in FIG. 14 can be formed of a unitary sheet of paper board. The die cut blank 12 can be shaped as desired and the lines of frangibility 160 can be provided. If desired, a tear strip 110 can be joined to the shell layer 20 in the desired location. The lines of frangibility 160 can be provided before or after joining the tear strip 110 to the predetermined removable portion 70.

The core layer 100 can be folded about the transverse edge 22 to form the blank 12 to bring the core layer 100 shell layer 20 into facing relationship with the core layer 100 overlying the predetermined removable portion 70. The core layer 100 can be optionally glued, taped, or heat sealed to the shell layer 20 to provide for rigidity to the erected container 10.

Figure 15:
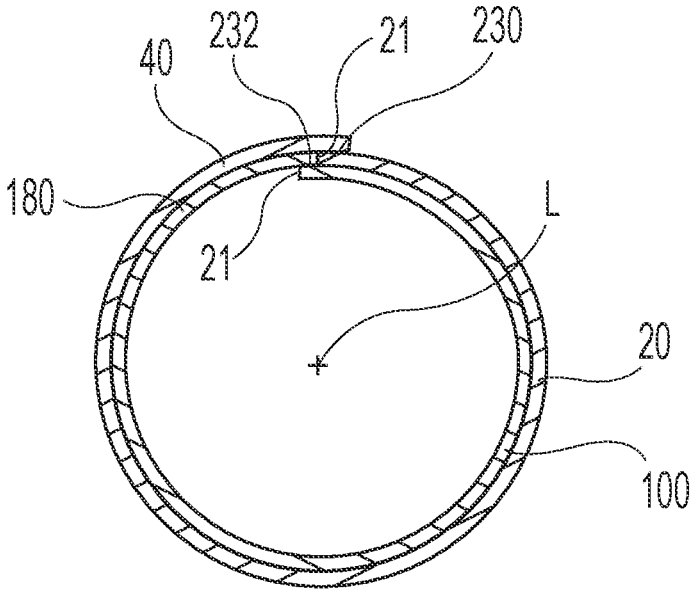
FIG. 15. A top view of an opened container.
Figure 16:
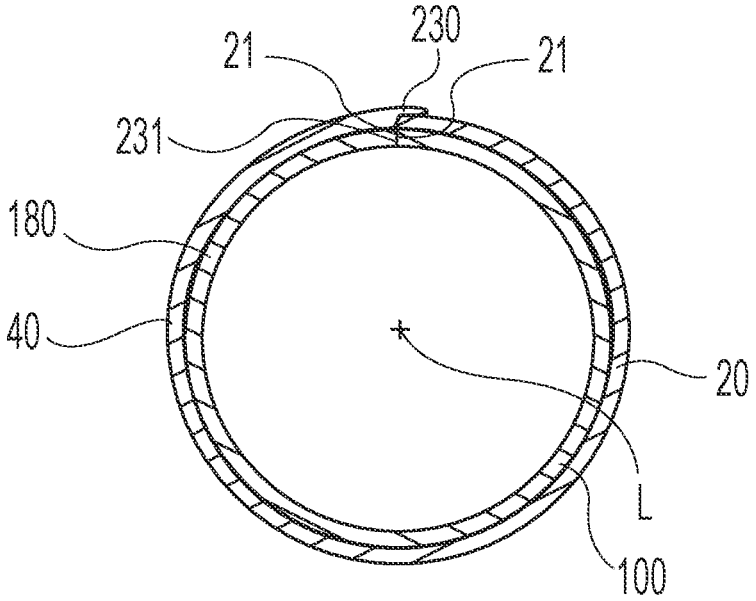
FIG. 16. A top view of an opened container.

Providing a core layer 100 in which at least parts of the two core layer side edges 21 abut or overlap one another can be practical (FIGS. 15 and 16). The parts of the core layer side edges 21 that abut or overlap one another can be at least between the lower line of limitation 60 and the upper line of limitation 80. The parts of the core layer side edges 21 that abut or overlap one another can be between the shell bottom edge 30 and the upper line of limitation 80. The parts of the core layer side edges 21 that abut or overlap one another can extend only partway between the shell bottom edge 30 and the upper line of limitation 80. Providing only part of the of the two core layer side edges 21 abutting or overlapping one another can improve the ability to handle and erect the blank 12 for forming the container 10.

The core layer 100 can have two core layer side edges 21 and the core layer 100 can extend between the side edges 21 about the longitudinal axis L. Such an arrangement can result in a locally thick portion of the container from the base 32 along the height of the container 10. After the container 10 is opened, the cap portion 90 can be wedged or otherwise forced over the lower line of limitation 60 at the body portion 50 to tightly engage the cap portion 90 with the body portion 50. The cap portion 90 can have enough flexibility or deformability to be stretched or fitted over the lower line of limitation 60 about the periphery of the body portion 50 about the longitudinal axis L or the body portion 50 proximal the lower line of limitation 60 can be deformed to be wedged with the cap portion 90 fitted thereto. The wedge fit between the cap portion 90 and the body portion 50 can be sufficiently strong to help reduce the potential for the contents of the container 10 spilling when a previously opened container 10 that is closed with the cap portion 90 is accidentally tipped over or inverted. Providing an abutting or overlapping relationship in the side edges 21 of the core layer 100 can also help reduce the potential for the articles 270 to spill out of the container 10 when the container 10 is opened, especially when the fill level 99 is above the lower line of limitation 60, and reduce the potential for messy pouring of the articles 270 from a gap in the core layer 100 when the articles 270 are dispensed from the container 10 if the body portion 50 is not carefully oriented so that a discontinuity in the core layer 100 is higher than the location on the core rim 180 over which the articles 270 may be dispensed or poured. It may be noted that the cap portion 90 may have the same seam and shape as the shell layer 20 proximal the lower line of limitation 60. As such one or both of the body portion proximal the lower line of limitation 60 and the cap portion 90 proximal the lip 23 can be deformed so that the cap portion 90 can be wedge fitted to the body portion 50.

The side edges 21 of the core layer 100 can be joined to one another by a butt seam 231 or can be part of a longitudinal core overlapping seam 232. A butt seam 231 can be formed by taping or otherwise joining the side edges 21 of the core layer 100. A core overlapping seam 232 can be formed by gluing or heat sealing the side edges 21 in an overlapping relationship. The side edges 21 can be part of a longitudinal core overlapping seam 232. Optionally, the core overlapping seam 232 can nest with the overlapping longitudinal seam 230. A nonlimiting example of a nesting relationship is shown in FIG. 15. The overlapping longitudinal seam 230 and the core overlapping seam 232 overlap about the longitudinal axis L in the same direction (for example clockwise or counterclockwise, counterclockwise being illustrated in FIG. 15) from outer to inner. Outer is used in this sense in that outer is further away from the longitudinal axis L than inner. Providing both the overlapping longitudinal seam 230 and the core overlapping seam 232 can provide for additional local wall thickness to the container 10 from the base 32 along the height of the container 10. After the container 10 is opened, the cap portion 90 can be wedged over the top of the body portion 50 to tightly engage the cap portion 90 with the body portion 50 by way of the same or similar mechanisms discussed previously with respect to the side edges 21 abutting one another.

For a container 10 that is a substantially right circular cylinder, providing a longitudinal core overlapping seam 232 or butt seam 232 can be practical in that the core layer 100 may not have a precisely circular cross section orthogonal to the longitudinal axis L. If the shell layer 20 has longitudinal seam 230 that is an overlapping seam, the cap portion 90 may not have a precisely circular cross section orthogonal to the longitudinal axis L. Since the shell layer 20 and the core layer 100 may be joined to one another and the constituent paperboard materials have some flexibility, the core layer 100 may conform, at least to some degree, with the shape of the shell layer 20 orthogonal to the longitudinal axis L. After removing the cap portion 90, the cap portion 90 can be refitted to the core layer 100. The substantially circular cross section of the cap portion 90, which is formed from the shell layer 20, and the core layer 100 orthogonal to the longitudinal axis L can be wedge fitted to one another by positioning the longitudinal seam 230 of the shell layer out of alignment with the core overlapping seam 232 when the cap portion 90 is refitted to the core layer 100. This may be achieved by positioning the longitudinal seam 230 out of alignment with the core overlapping seam 232 before fitting the cap portion 90 onto the core layer 100. This may optionally be achieved by fitting the cap portion 90 onto the core layer 100 with the longitudinal seam 230 and core overlapping seam 232 position the longitudinal seam 230 in alignment or near alignment and then slightly rotating the cap portion 90 about the longitudinal axis L to cam the interior of the cap portion 90 with the exterior of the shell layer 20. The engagement mechanism may be thought of as being similar to taking two concentric ovals and slightly rotating one of the ovals about the longitudinal axis relative to the other. The shape of the outer oval can resist relative rotation of the inner oval, or vice versa, and at some degree of rotation amongst the ovals the combination of the normal force developed between the two ovals and the coefficient of friction of the material forming the ovals can fix the rotational relationship between the ovals within some range of applied rotational force in either direction about the longitudinal axis L. That developed friction force can also resist separation of the cap portion 90 from the shell layer 20 in the direction of the longitudinal axis L. Since the core layer 100 and shell layer 20 are paperboard materials, cap portion 90 and the part of the core layer 100 above the lower line of limitation 60 can deform slightly to reasonably securely engage the cap portion 90 with the core layer 100. This engagement mechanism may not require as much deformation as an engagement mechanism in which the lip 23 of the cap portion 90 is fitted over the shell layer 20 proximal the lower line of limitation 60.

The two side edges 21 and the overlapping longitudinal seam 230 can be within about 15 degrees of one another about the longitudinal axis L.

Providing a core layer 100 in which at least parts of the two core layer side edges 21 abut or overlap one another can be practical for providing a continuous core rim 180. A continuous core rim 180 can be desirable for enabling the articles 270 in the container 10 to be dispensed or poured out of the container 10 at any position about the longitudinal axis L. A continuous core rim 180 can also allow the articles 270 to be filled to a fill level 99 above the lower line of limitation 60 and below the lowest location on the core rim 180.

Figure 17:
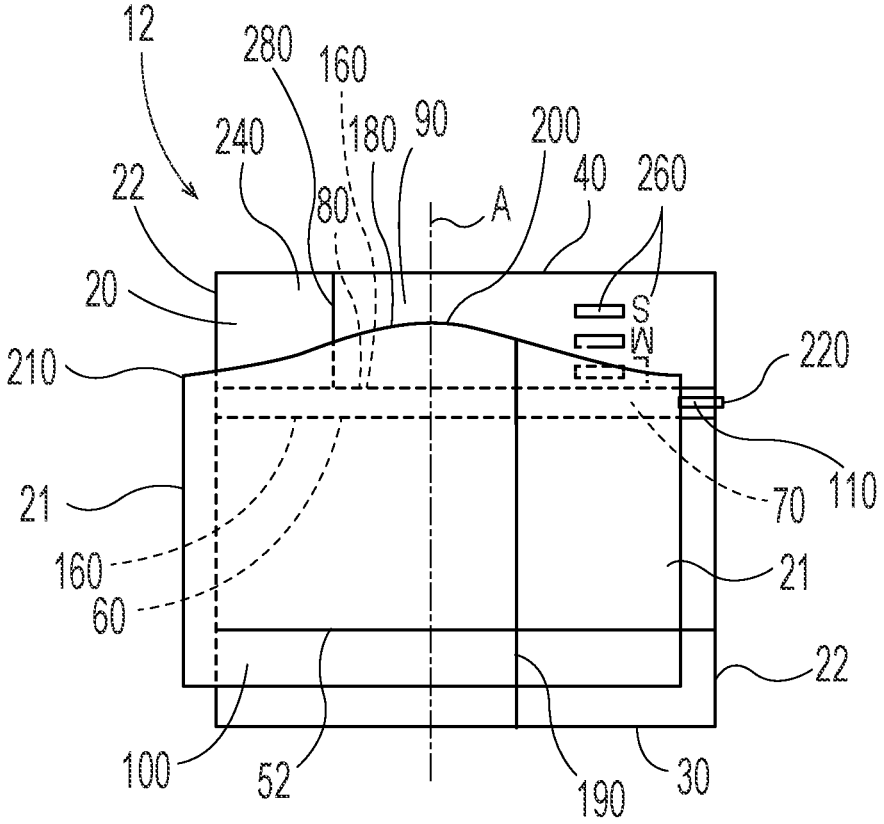
FIG. 17. A blank for constructing a container.

A blank 12 for forming a container 10 having a core layer 100 having a butt seam 231 or core overlapping seam 232 is shown in FIG. 17. To form such a butt seam 231 or core overlapping seam 232, the paperboard core layer 100 can comprise two core layer side edges 21. When the core layer 100 is in facing relationship with the shell layer 20, the core layer 100 extends from below the lower line of limitation 60 to the core rim 180 above the upper line of limitation and one of the side edges 21 is further away from the central axis A than one of the transverse edges 22. Optionally, the core layer 100 can extend from and be unitary with one of the transverse edges 21 and be foldable about one of the side edges 21. The central axis A can be between the free end 112 and the side edge 21 that is further away from the central axis A than one of the transverse edges 22 is. The attributes of the of the other blanks 12 described herein are common to the blank 12 shown in FIG. 17 to the extent that such attributes can be consistent with a blank 12 in which the core layer 100 is offset from the shell layer 20 with respect to the central axis A as shown in FIG. 17. The blank 12 shown in FIG. 17 can be folded or rolled around a mandrel to bring one of the side edges 21 into an abutting relationship with the other side edge 21 to form a butt seam 231 in the core layer 100. Optionally, one of the side edges 21 can be positioned further away from the central axis A so that there is a sufficient overlap of the core layer 100 to form core overlapping seam 232 when the blank 12 is folded or rolled around a mandrel.

An Example Follows:

A. A container blank (12) comprising:

a paperboard shell layer (20) comprising two transverse edges (22) on opposing sides of a central axis (A), a shell bottom edge (30) extending between said transverse edges orthogonal to said central axis, and a shell top edge (40) opposite said shell bottom edge and extending between said transverse edges;

wherein said shell layer comprises:

a body portion (50) extending from said shell bottom edge to a lower line of limitation (60);

a predetermined removeable portion (70) extending from said lower line of limitation to an upper line of limitation (80); and a cap portion (90) extending from said upper line of limitation to said shell top edge;

a paperboard core layer (100), wherein when said core layer is in facing relationship with said shell layer said core layer extends from below said lower line of limitation to a core rim (180) above said upper line of limitation; and an optional a tear strip (110) joined to said predetermined removable portion; wherein when said core layer is in facing relationship with said shell layer said core rim is located at a rim distance (190) from said shell bottom edge as measured parallel to said central axis and said rim distance is a function of distance from said central axis; and wherein when said core layer is in facing relationship with said shell layer said core rim has a rim distance global maxima (200) and a rim distance global minima (210) relative to said shell bottom edge.

B. The container blank according to Paragraph A, wherein said core layer extends from and is unitary with one of said transverse edges and is foldable about said transverse edge.

C. The container blank according to Paragraph A or B, wherein when said core layer is in facing relationship with said shell layer when said global maxima is at said central axis.

D. The container blank according to any of Paragraphs A to C, wherein said core rim is sinusoidal.

E. The container blank according to any of Paragraphs A to D, wherein said shell top edge is away from said shell bottom edge by a distance greater than said rim distance global maxima plus a maximum distance between said upper line of limitation and said lower line of limitation measured parallel to said central axis.

F. The container blank according to any of Paragraphs A to E, wherein said cap portion has a cap portion height (280) measured parallel to said central axis between said upper line of limitation and said shell top edge and said predetermined removeable portion has a predetermined removeable portion maximum height (290) measured parallel to said central axis and said cap portion height is greater than said predetermined removeable portion height.

G. The container blank according to any of Paragraphs A to F, wherein said predetermined removeable portion extends between and intersects said transverse edges.

H. The container blank according to any of Paragraphs A to G, wherein said lower line of limitation and said upper line of limitation are lines of frangibility (160).

I. The container blank according to any of Paragraphs A to H, wherein said body portion has a body portion length (52) between said transverse edges orthogonal to said central axis immediately below said lower line of limitation; and wherein when said core layer is in facing relationship with said shell layer, at said rim distance global minima said core layer extends above said upper line of limitation by from about 5% to about 50% of said body portion length.

J. The container blank according to any of Paragraphs A to I, wherein when said core layer is in facing relationship with said shell layer said shell layer has and interior facing surface (240) oriented towards said core layer, wherein said interior facing surface above said lower line of limitation comprises at least one dosing indicia (260).

K. The container blank according to any of Paragraphs A to J, wherein said core layer and said shell layer are nonunitary.

L. The container blank according to any of Paragraphs A to K, wherein said core rim comprises a notch (185).

M. The container blank according to any of Paragraphs A to L, wherein said container blank further comprises a tear strip (110) joined to said predetermined removable portion.

N. The container blank according to any of Paragraphs A to M, wherein said lower line of limitation is a line of frangibility (160) defined by a plurality of structural disruptions (161) of said shell layer spaced apart from one another, wherein said lobe is defined by more than two said structural disruptions (161), optionally said structural disruptions are selected from the group consisting of through cuts, score cuts, through die continuous cut, through die continuous cuts, partial die continuous cut, partial die cuts, zipper die cuts, perforations from which material has been removed, and combinations thereof.

O. A container blank (12) comprising:

a paperboard shell layer (20) comprising two transverse edges (22) on opposing sides of a central axis (A), a shell bottom edge (30) extending between said transverse edges orthogonal to said central axis, and a shell top edge (40) opposite said shell bottom edge and extending between said transverse edges;

wherein said shell layer comprises:

a body portion (50) extending from said shell bottom edge to a lower line of limitation (60); a predetermined removeable portion (70) extending from said lower line of limitation to an upper line of limitation (80); and a cap portion (90) extending from said upper line of limitation to said shell top edge;

a paperboard core layer (100), wherein when said core layer is in facing relationship with said shell layer said core layer extends from below said lower line of limitation to a core rim (180) above said upper line of limitation; and an optional a tear strip (110) joined to said predetermined removable portion;

wherein said body portion comprises a lobe (120) immediately below said lower line of limitation and has a body portion length (52) between said transverse edges orthogonal to said central axis immediately below said lobe;

wherein said lobe has a lobe length (142) orthogonal to said central axis and said lobe length is more than about 5% of said body portion length;

wherein said lobe has a lobe exterior height (150) parallel to said central axis and said lobe has a lobe length to lobe height ratio greater than about 1.

P. The container blank according to Paragraph O, wherein said core layer extends from and is unitary with one of said transverse edges and is foldable about said transverse edge.

Q. The container blank according to Paragraph O or P, wherein said body portion comprises a plurality of said lobes.

R. The container blank according to any of Paragraphs O to Q, wherein said upper line of limitation is orthogonal to said central axis.

S. The container blank according to any of Paragraphs O to R, wherein said lower line of limitation and said upper line of limitation are lines of frangibility (160).

T. The container blank according to any of Paragraphs O to S, wherein said container blank comprises two said lobes and said lobes are spaced apart from one another by straight segments (170) of said lower line of limitation.

U. The container blank according to any of Paragraphs O to T, wherein said body portion comprises two said lobes and said two lobes are on opposite sides of said central axis.

V. The container blank according to any of Paragraphs O to U, wherein said body portion comprises three or four said lobes and said lobes are evenly spaced apart.

W. The container blank according to any of Paragraphs O to V, wherein said body portion comprises a plurality of said lobes and said lobes are spaced apart from one another by from about 10% to about 80% of said lobe length.

X. The container blank according to any of Paragraphs O to W, wherein said core layer extends above said upper line of limitation by from about 5% to about 50% of said body portion length.

Y. The container blank according to any of Paragraphs O to X, wherein said lobe has a curved upper contour (122).

Z. The container blank according to any of Paragraphs O to Y, wherein said body portion comprises three or more said lobes and said lobes adjacent to one another have lobe exterior heights 150 that vary from one another.

AA. The container blank according to any of Paragraphs O to Z, wherein said core layer extends to a core rim (180) above said upper line of limitation, wherein said core rim is located at a rim distance (190) from said shell bottom edge as measured parallel to said central axis and said rim distance is a function of position relative to said central axis, and wherein said core rim has a rim distance global maxima (200) and a rim distance global minima (210) relative to said shell bottom edge.

BB. The container blank according to Paragraph AA, wherein said core rim is oriented at an angle that is more than about five degrees above said shell bottom edge.

CC. The container blank according to any of Paragraph AA or BB, when said core layer is in facing relationship with said shell layer said shell layer has an interior facing surface (240) oriented towards said core layer, wherein said interior facing surface above said lower line of limitation comprises at least one dosing indicia (260).

DD. The container blank according to any of Paragraphs AA to CC, wherein said predetermined removable portion extends between and intersects said transverse edges.

EE. The container blank according to any of Paragraphs AA to DD, wherein said core layer and said shell layer are nonunitary.

FF. The container blank according to any of Paragraphs O to EE, wherein said core layer is in facing relationship with said shell layer.

GG. The container blank according to any of Paragraphs O to FF, wherein said core rim comprises a notch (185).

HH. The container blank according to any of Paragraphs O to GG, wherein said container blank further comprises a tear strip (110) joined to said predetermined removable portion.

II. The container blank according to any of Paragraphs O to HH, wherein said lower line of limitation is a line of frangibility (160) defined by a plurality of structural disruptions (161) of said shell layer spaced apart from one another, wherein said lobe is defined by more than two said structural disruptions (161), optionally said structural disruptions are selected from the group consisting of through cuts, score cuts, through die continuous cut, through die continuous cuts, partial die continuous cut, partial die cuts, zipper die cuts, perforations from which material has been removed, and combinations thereof.

JJ. A container blank (12) comprising:

a paperboard shell layer (20) comprising two transverse edges (22) on opposing sides of a central axis (A), a shell bottom edge (30) extending between said transverse edges orthogonal to said central axis, and a shell top edge (40) opposite said shell bottom edge and extending between said transverse edges;

wherein said shell layer comprises:

a body portion (50) extending from said shell bottom edge to a lower line of limitation (60); a predetermined removeable portion (70) extending from said lower line of limitation to an upper line of limitation (80); and a cap portion (90) extending from said upper line of limitation to said shell top edge; and a paperboard core layer (100) comprising two core layer side edges (21), wherein when said core layer is in facing relationship with said shell layer said core layer extends from below said lower line of limitation to a core rim (180) above said upper line of limitation and one of said side edges is further away from said central axis than one of said transverse edges.

KK. The container blank according to Paragraph JJ, wherein said core layer extends from and is unitary with one of said transverse edges and is foldable about one of said side edges.

LL. The container blank according to Paragraph JJ or KK, wherein when said core layer is in facing relationship with said shell layer said core rim is located at a rim distance (190) from said shell bottom edge as measured parallel to said central axis and said rim distance is a function of distance from said central axis, and wherein when said core layer is in facing relationship with said shell layer said core rim has a rim distance global maxima (200) and a rim distance global minima (210) relative to said shell bottom edge.

MM. The container blank according to any of Paragraphs JJ to LL, wherein said core layer extends to a core rim (180) above said upper line of limitation, wherein said core rim is located at a rim distance (190) from said shell bottom edge as measured parallel to said central axis and said rim distance is a function of position relative to said central axis, and wherein said core rim has a rim distance global maxima (200) and a rim distance global minima (210) relative to said shell bottom edge.

NN. The container blank according to any of Paragraphs JJ to MM, wherein said predetermined removable portion has a free end (112), wherein said central axis is between said free end and said side edge that is further away from said central axis than one of said transverse edges is.

OO. The container blank according to any of Paragraphs JJ to NN, wherein said core rim is sinusoidal.

PP. The container blank according to any of Paragraphs JJ to OO, wherein said shell top edge is away from said shell bottom edge by a distance greater than said rim distance global maxima plus a maximum distance between said upper line of limitation and said lower line of limitation measured parallel to said central axis.

QQ. The container blank according to any of Paragraphs JJ to PP, wherein said cap portion has a cap portion height (280) measured parallel to said central axis between said upper line of limitation and said shell top edge and said predetermined removeable portion has a predetermined removeable portion maximum height (290) measured parallel to said central axis and said cap portion height is greater than said predetermined removeable portion height.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A container blank comprising:

a paperboard shell layer comprising two transverse edges on opposing sides of a central axis, a shell bottom edge extending between said transverse edges orthogonal to said central axis, and a shell top edge opposite said shell bottom edge and extending between said transverse edges;

wherein said shell layer comprises:

a body portion extending from said shell bottom edge to a lower line of limitation;

a predetermined removeable portion extending from said lower line of limitation to an upper line of limitation; and a cap portion extending from said upper line of limitation to said shell top edge; and a paperboard core layer, wherein when said core layer is in facing relationship with said shell layer said core layer extends from below said lower line of limitation to a core rim above said upper line of limitation;

wherein when said core layer is in facing relationship with said shell layer said core rim is located at a rim distance from said shell bottom edge as measured parallel to said central axis and said rim distance is a function of distance from said central axis;

wherein when said core layer is in facing relationship with said shell layer said core rim has a rim distance global maxima and a rim distance global minima relative to said shell bottom edge; and wherein said core rim is sinusoidal.

2. The container blank according to claim 1, wherein said core layer extends from and is unitary with one of said transverse edges and is foldable about said transverse edge.

3. The container blank according to claim 1, wherein when said core layer is in facing relationship with said shell layer when said global maxima is at said central axis.

4. The container blank according to claim 1, wherein said shell top edge is away from said shell bottom edge by a distance greater than said rim distance global maxima plus a maximum distance between said upper line of limitation and said lower line of limitation measured parallel to said central axis.

5. The container blank according to claim 1, wherein said cap portion has a cap portion height measured parallel to said central axis between said upper line of limitation and said shell top edge and said predetermined removeable portion has a predetermined removeable portion maximum height measured parallel to said central axis and said cap portion height is greater than said predetermined removeable portion height.

6. The container blank according to claim 1, wherein said container blank further comprises a tear strip joined to said predetermined removable portion.

7. The container blank according to claim 1, wherein said core layer extends from and is unitary with one of said transverse edges and is foldable about said transverse edge, and wherein when said core layer is in facing relationship with said shell layer when said global maxima is at said central axis.

8. The container blank according to claim 7, wherein said shell top edge is away from said shell bottom edge by a distance greater than said rim distance global maxima plus a maximum distance between said upper line of limitation and said lower line of limitation measured parallel to said central axis.

9. The container blank according to claim 8, wherein said cap portion has a cap portion height measured parallel to said central axis between said upper line of limitation and said shell top edge and said predetermined removeable portion has a predetermined removeable portion maximum height measured parallel to said central axis and said cap portion height is greater than said predetermined removeable portion height.

10. The container blank according to claim 9, wherein said container blank further comprises a tear strip joined to said predetermined removable portion.

11. A container blank comprising:

a paperboard shell layer comprising two transverse edges on opposing sides of a central axis, a shell bottom edge extending between said transverse edges orthogonal to said central axis, and a shell top edge opposite said shell bottom edge and extending between said transverse edges;

wherein said shell layer comprises:

a body portion extending from said shell bottom edge to a lower line of limitation;

a predetermined removeable portion extending from said lower line of limitation to an upper line of limitation; and a cap portion extending from said upper line of limitation to said shell top edge; and a paperboard core layer, wherein when said core layer is in facing relationship with said shell layer said core layer extends from below said lower line of limitation to a core rim above said upper line of limitation;

wherein said body portion comprises a lobe immediately below said lower line of limitation and has a body portion length between said transverse edges orthogonal to said central axis immediately below said lobe;

wherein said lobe has a lobe length orthogonal to said central axis and said lobe length is more than 5% of said body portion length;

wherein said lobe has a lobe exterior height parallel to said central axis and said lobe has a lobe length to lobe height ratio greater than 1.

12. The container blank according to claim 11, wherein said core layer extends from and is unitary with one of said transverse edges and is foldable about said transverse edge.

13. The container blank according to claim 11, wherein said body portion comprises two said lobes and said two lobes are on opposite sides of said central axis.

14. The container blank according to claim 11, wherein said core layer extends to a core rim above said upper line of limitation, wherein said core rim is located at a rim distance from said shell bottom edge as measured parallel to said central axis and said rim distance is a function of position relative to said central axis, and wherein said core rim has a rim distance global maxima and a rim distance global minima relative to said shell bottom edge.

15. The container blank according to claim 11, when said core layer is in facing relationship with said shell layer said shell layer has an interior facing surface oriented towards said core layer, and wherein said interior facing surface above said lower line of limitation comprises at least one dosing indicia.

* * * * *